US008157052B2

(12) United States Patent
Fujimori et al.

(10) Patent No.: US 8,157,052 B2
(45) Date of Patent: Apr. 17, 2012

(54) ACOUSTIC STRUCTURE

(75) Inventors: Junichi Fujimori, Hamamatsu (JP); Yoshikazu Honji, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/660,813

(22) Filed: Mar. 4, 2010

(65) Prior Publication Data

US 2010/0224441 A1 Sep. 9, 2010

(30) Foreign Application Priority Data

Mar. 6, 2009 (JP) ..... 2009-053709
Mar. 3, 2010 (JP) ..... 2010-047185

(51) Int. Cl.
*E04B 1/84* (2006.01)
*E04B 1/82* (2006.01)
*E04B 1/74* (2006.01)

(52) U.S. Cl. ..... 181/293; 181/295

(58) Field of Classification Search ..... 181/284, 181/286, 293, 295, 206, 210; 52/144, 145
See application file for complete search history.

(56) References Cited

U.S. PATENT DOCUMENTS

| | | | | |
|---|---|---|---|---|
| 3,275,101 | A * | 9/1966 | Davis, Jr. et al. | 181/285 |
| 4,189,027 | A * | 2/1980 | Dean et al. | 181/286 |
| 4,231,447 | A * | 11/1980 | Chapman | 181/213 |
| 4,821,841 | A * | 4/1989 | Woodward et al. | 181/286 |
| 5,457,291 | A * | 10/1995 | Richardson | 181/293 |
| 5,512,715 | A * | 4/1996 | Takewa et al. | 181/295 |
| 5,598,669 | A * | 2/1997 | Hamdi et al. | 52/144 |
| 5,959,265 | A | 9/1999 | Van Ligten | |
| 6,021,612 | A | 2/2000 | Dunn et al. | |
| 6,167,985 | B1 * | 1/2001 | Van Ligten | 181/286 |
| 6,290,022 | B1 * | 9/2001 | Wolf et al. | 181/292 |
| 6,435,303 | B1 * | 8/2002 | Warnaka | 181/286 |
| 6,892,856 | B2 | 5/2005 | Takahashi et al. | |
| 2002/0017426 | A1 * | 2/2002 | Takahashi et al. | 181/293 |
| 2003/0006090 | A1 * | 1/2003 | Reed | 181/210 |
| 2005/0098379 | A1 * | 5/2005 | Sato et al. | 181/293 |
| 2008/0308061 | A1 * | 12/2008 | Yokota | 123/184.57 |
| 2010/0065369 | A1 * | 3/2010 | Honji | 181/293 |

FOREIGN PATENT DOCUMENTS

| | | | |
|---|---|---|---|
| EP | 2 159 787 | A2 | 3/2010 |
| JP | 06026130 | A * | 2/1994 |
| JP | 2002030744 | | 1/2002 |
| JP | 2010085989 | A * | 4/2010 |
| WO | WO 96/23294 | | 8/1996 |
| WO | WO 03/063131 | A1 | 7/2003 |

* cited by examiner

OTHER PUBLICATIONS

Extended European Search Report of European Patent Application No. 10002304.3 of Yamaha Corporation, dated Jul. 27, 2010, 8 pages.

*Primary Examiner* — Edgardo San Martin
(74) *Attorney, Agent, or Firm* — Pillsbury Winthrop Shaw Pittman LLP

(57) ABSTRACT

In an acoustic structure, sound absorbing effect is achieved by interference between incident waves falling in an opening portion and reflected waves radiated from the opening as a result of resonance occurring within a hollow member in response to the incident waves, and a sound absorbing region is formed, for example, in a frontal direction of the opening portion. Sound scattering effect is achieved through interaction between the above-mentioned interference and interference between the incident waves and sound waves radiated from the opening portion, and a sound scattering region is formed, for example, near the sound absorbing region. A sound scattering effect is achieved by flows of gas molecules being produced in an oblique direction, not normal to the opening portion and reflective surface, due to a phase difference between the sound waves radiated from the opening portion and the sound waves radiated from the reflective surface.

16 Claims, 12 Drawing Sheets

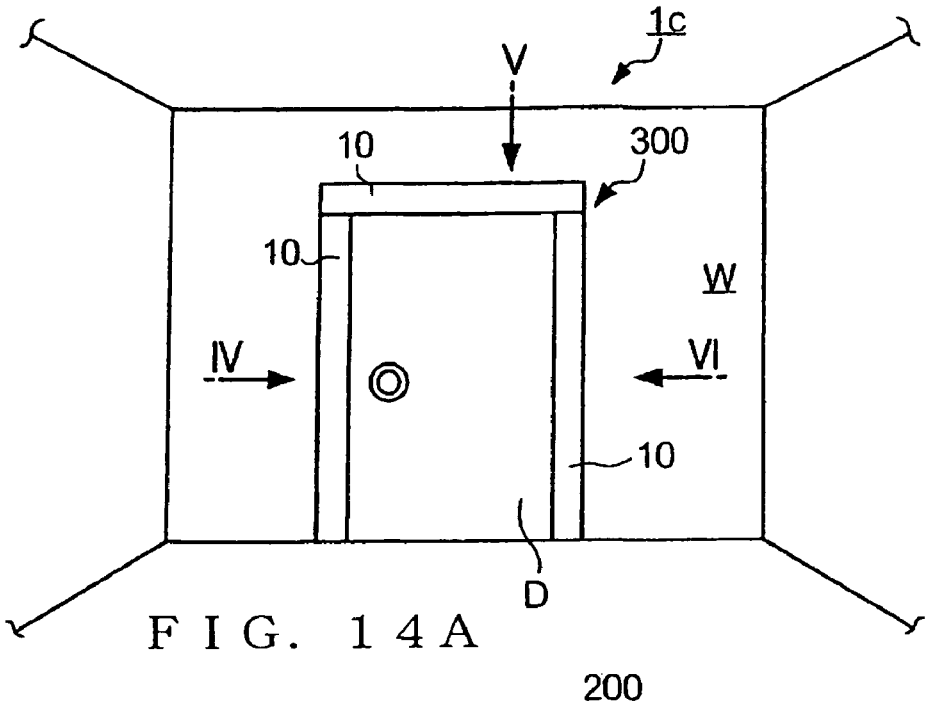
FIG. 14A
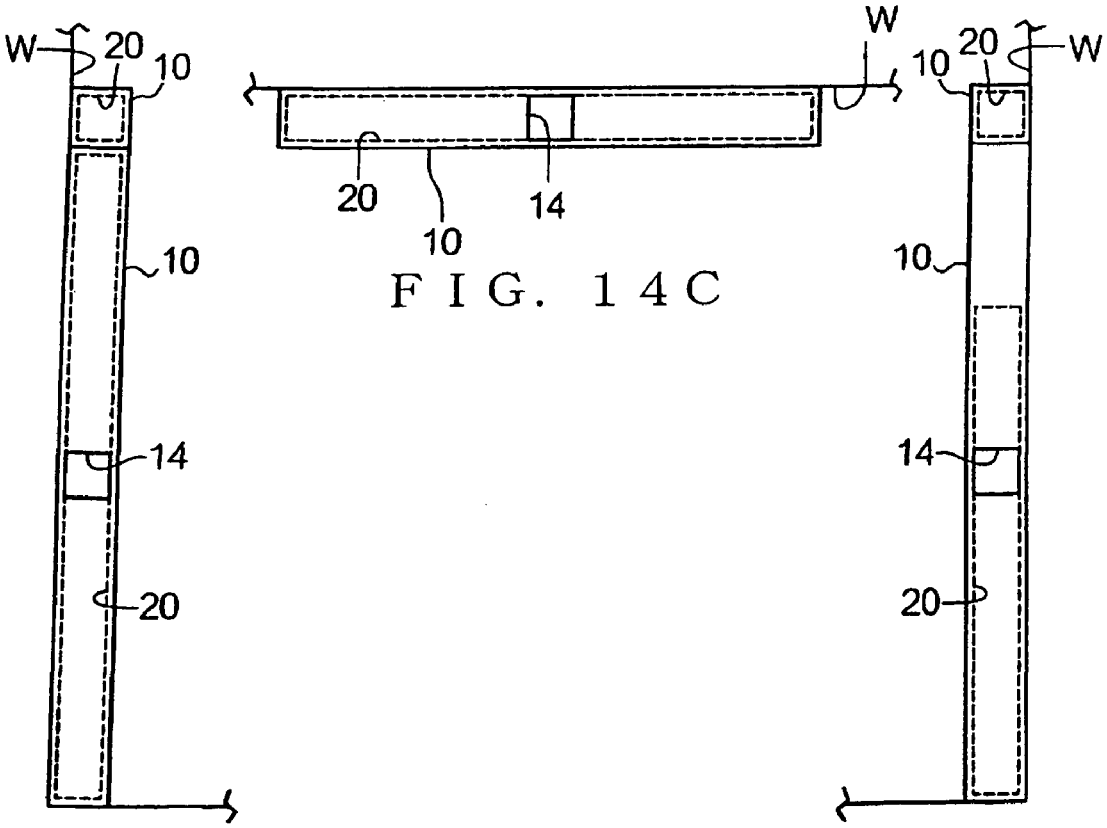
FIG. 14C
FIG. 14B
FIG. 14D

ACOUSTIC STRUCTURE

BACKGROUND

The present invention relates to techniques for absorbing and scattering a sound.

In acoustic spaces of halls, theaters, etc., acoustic structures for scattering sounds are installed in order to remove acoustic interferences, such as flutter echoes. Japanese Patent Application Laid-open Publication No. 2002-30744, for example, discloses an acoustic structure, in which a hollow space is formed to extend in one direction, and in which a plurality of members, each having an opening that allows the hollow space to communicate with an external space are arranged. Once a sound wave enters the hollow space, it is re-radiated through the openings of the members, so that a sound scattering effect can be achieved.

With a relatively small space, such as a living or sitting room of an ordinary house, a meeting room or a music room, it is required to achieve not only an appropriate sound scattering effect but also an appropriate sound absorbing effect. However, if an acoustic structure for achieving a sound scattering effect and an acoustic structure for achieving a sound absorbing effect are provided separately in a limited space, the separate acoustic structures would take up much of the space. Further, if an acoustic structure is made using a porous sound absorbing material, such as felt, with a view to enhancing a sound absorbing effect for low frequency bands, the acoustic structure would increase in dimension in its thickness direction and thus further narrow the limited space.

SUMMARY OF THE INVENTION

In view of the foregoing, it is an object of the present invention to provide an improved technique which can not only effectively scatter a sound but also achieve a sound absorbing effect over wide frequency bands while avoiding a size increase of an acoustic structure.

In order to accomplish the above-mentioned object, the present invention provides an acoustic structure comprising: a resonator having a hollow region extending in one direction, the hollow region communicating with an external space via an opening portion; and a reflective surface disposed close to the opening portion and facing the external space, wherein incident sound waves fall in the opening portion and fall on the reflective surface from the external space. When the reflective surface radiates reflected waves in response to the incident sound waves, the resonator resonates in response to the incident sound waves and radiates reflected waves, differing in phase from the reflected waves from the reflective surface, via the opening portion. Further, a real part of a value calculated by dividing a specific acoustic impedance of the opening portion by a characteristic impedance of a medium of the opening portion is almost zero.

In the acoustic structure of the present invention, where the opening portion of the resonator is located close to the reflective surface, reflected waves at the reflective surface and reflected waves at the opening portion of the acoustic structure interfere with each other, and phases of the reflected waves at the opening portion and the reflective surface become discontinuous with each other in a boundary region between the opening portion and the reflected surface, so that a flow of gas molecules occurs and thus a sound scattering effect can be achieved. It is preferable that the opening portion lie in non-parallel relation to the reflective surface. Further, a sound absorbing effect can be achieved by energy loss resulting from the flow of gas molecules. Further, through a resonance phenomenon, amplitudes of the reflected waves cancel out each other, so that, in an external space near the opening portion, a high sound absorbing effect can be achieved in a wide frequency band range including low frequency bands.

In a preferred embodiment, when the reflective surface radiates the reflected waves responsive to the incident sound waves and the resonator radiates the reflected waves based on resonance, the absolute value of the value calculated by dividing the specific acoustic impedance of the opening portion by the characteristic impedance of a medium of the opening portion is less than one.

According to another aspect of the present invention, there is provided an acoustic structure comprising: a resonator having a hollow region extending in one direction, the hollow region communicating with an external space via an opening portion, and a reflective surface located close to the opening portion and facing the external space, wherein, when the reflective surface radiates reflected waves, the resonator resonates in response to the incident sound waves and radiates reflected waves, differing in phase from the reflected waves from the reflective surface, via the opening portion. Further, a layer of gas where sound pressure is distributed uniformly is provided between the hollow region of the resonator and the opening portion, and the absolute value of a motion velocity of medium particles in the opening portion is greater than the absolute value of a motion velocity of medium particles on a boundary surface between the hollow region and the layer of gas.

According to still another aspect of the present invention, there is provided a program for calculating design conditions of an acoustic structure which includes: a resonator having a hollow region formed in the interior thereof and extending in one direction, the hollow region communicating with an external space via an opening portion; and a reflective surface disposed close to the opening portion and facing the external space, the program causing a computer to perform a step of calculating design conditions of the resonator and the opening portion in such a manner that, under a condition where incident sound waves fall in the opening portion and fall on the reflective surface from the external space and where, in response to the incident sound waves, the reflective surface radiates reflected waves and the resonator radiates reflected waves, differing in phase from the reflected waves from the reflective surface, through the opening portion, a real part of a value calculated by dividing a specific acoustic impedance of the opening portion by a characteristic impedance of a medium of the opening portion is caused to approach zero.

According to still another aspect of the present invention, there is provided a designing apparatus comprising a calculation section which calculates design conditions of an acoustic structure which includes: a resonator having a hollow region formed in the interior thereof and extending in one direction, the hollow region communicating with an external space via an opening portion; and a reflective surface disposed close to the opening portion and facing the external space, the calculation section calculates design conditions of the resonator and the opening portion in such a manner that, under a condition where incident sound waves fall in the opening portion and fall on the reflective surface from the external space, and, in response to the incident sound waves, the reflective surface radiates reflected waves and the resonator radiates reflected waves, differing in phase from the reflected waves from the reflective surface, through the opening portion, a real part of a value calculated by dividing a specific acoustic impedance of the opening portion by a characteristic impedance of a medium of the opening portion is caused to approach zero.

According to still another aspect of the present invention, there is provided a method for designing an acoustic structure which includes: a resonator having a hollow region formed in the interior thereof and extending in one direction, the hollow region communicating with an external space via an opening portion; and a reflective surface disposed close to the opening portion and facing the external space, the method comprising designing the resonator and the opening portion in such a manner that, under a condition where incident sound waves fall in the opening portion and fall on the reflective surface from the external space, and, in response to the incident sound waves, the reflective surface radiates reflected waves and the resonator radiates reflected waves, differing in phase from the reflected waves from the reflective surface, through the opening portion, a real part of a value calculated by dividing a specific acoustic impedance of the opening portion by a characteristic impedance of a medium of the opening portion is caused to approach zero.

The present invention constructed in the aforementioned manner can achieve sound absorption and sound scattering over wide frequency bands while effectively avoiding a size increase of the acoustic structure. The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIGS. 14A to 14D are views of a second modified acoustic structure;

DETAILED DESCRIPTION

Figure 1:
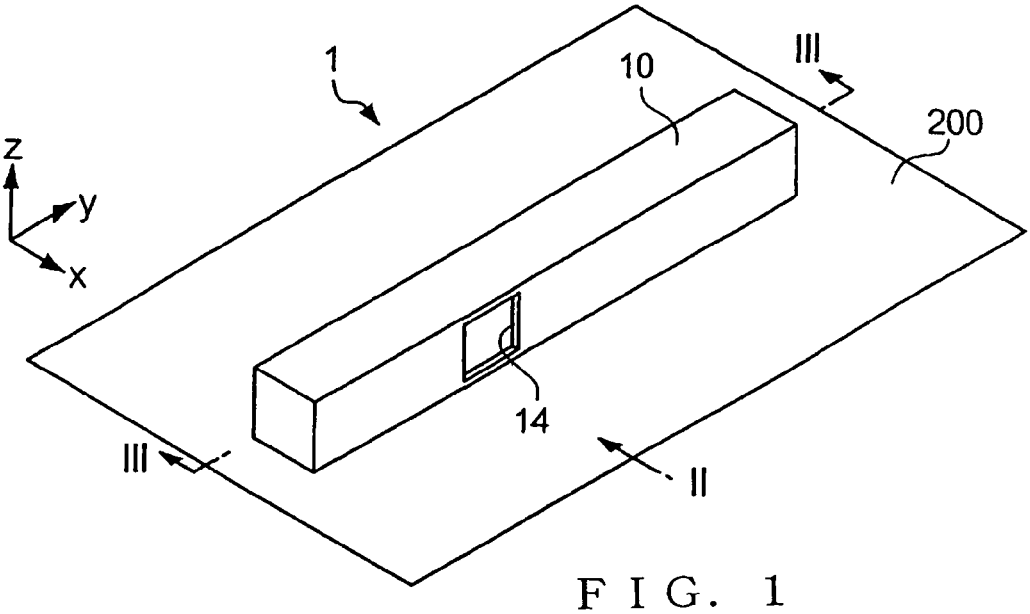
FIG. 1 is a perspective view showing an outer appearance of an embodiment of an acoustic structure of the present invention.
Figure 2:
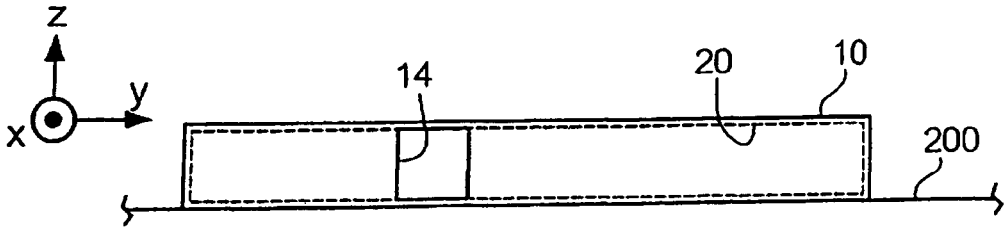
FIG. 2 is a view of the acoustic structure taken in a direction of an arrow II of FIG. 1.

FIG. 1 is a perspective view showing an outer appearance of an embodiment of an acoustic structure 1 of the present invention, and FIG. 2 is a view of the acoustic structure 1 taken in a direction of an arrow II of FIG. 1.

The acoustic structure 1 comprises a hollow member 10 and a reflective surface 200. The hollow member 10 is formed, for example, acrylic resin and has an outer appearance of a rectangular parallelepiped shape. The acoustic structure 1 is fixed at one side surface to part of a flat reflective surface 200, for example, by means of an adhesive, fixing member or the like in such a manner that the one side surface is kept in contact with the reflective surface 200. The hollow member 10 has an interior hollow region 20 formed to extend in one direction (i.e., y direction). Of the side surfaces of the hollow member 10, one which lies vertical or normal to the flat reflective surface 200, has an opening portion 14 located adjacent to the reflective surface 200. In this embodiment, the opening portion 14 is located adjacent to the reflective surface 200 in non-parallel relation to the reflective surface 200. The opening portion 14 is a space region to allow the sound propagating interior hollow region 20, located within the hollow member 10, to communicate with the external space. The reflective surface 200 is formed of a reflective material having a relatively high rigidity and faces the external space. The reflective surface 200 is, for example, a ceiling, wall surface or floor surface that forms an acoustic room of a theater, house, office building or the like, and it faces an acoustic space that is the external space in the illustrated embodiment.

Although only one hollow member 10 is provided in the illustrated embodiment, two or more hollow members 10 may be provided. The opening portion 14 may be of any shape, such as a polygonal shape or circular shape. Further, for convenience of description, of directions perpendicular to the direction in which the hollow member 10 extends (i.e., y direction), the direction parallel to the reflective surface 200 is referred to as "x direction". Further, the direction normal to the reflective surface 200 and perpendicular to the x and y directions is referred to as "z direction".

Figure 3:
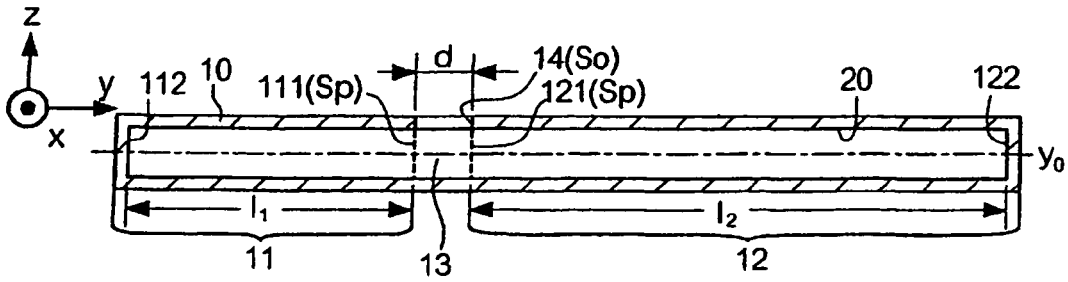
FIG. 3 is a sectional view of the hollow member taken along the III-III line of FIG. 1.

The following describe in greater detail the construction of the hollow member 10. FIG. 3 is a sectional view of the hollow member 10 taken along the III-III line of FIG. 1. As shown in FIGS. 2 and 3, the interior hollow region 20 is a space region of a substantially rectangular parallelepiped shape. In the illustrated example, the hollow member 10 is closed at opposite ends 112 and 122.

The hollow member 10 includes first and second resonators 11 and 12, an intermediate layer 13, and the opening portion 14. The first resonator 11 is formed in a portion of the interior hollow region 20 extending from the one end 112 of the hollow member 10 to one end surface 111 that is a boundary surface between the first resonator 11 and the intermediate layer 13, while the second resonator 12 is formed in a portion of the interior hollow region 20 extending from the other end 122 of the hollow member 10 to the other end surface 121 that is a boundary surface between the second resonator 12 and the intermediate layer 13. Once sound waves of resonant frequencies arrive at or fall on the hollow member 10, the resonators 11 and 12 resonate and radiate waves, produced by the resonance, to the external space via the opening portion 14. These resonators 11 and 12 are constructed to share a same center axis yo. The resonator 11 has a length $l_1$ in the y direction, and the resonator 12 has a length $l_2$ in the y direction. Further, the boundary surface 111 between the portion of the interior hollow region 20 constructed as the resonator 11 and the intermediate layer 13 has an area Sp, and the boundary surface 121 between the other portion of the interior hollow region 20 constructed as the resonator 12 and the intermediate layer 13 too has an area Sp. Each of the resonators 11 and 12 also has a sectional area Sp when cut along the x-z plane vertical to the extending direction of the interior hollow region 20. The sectional surface of each of the resonators 11 and 12 has a length in each of the x and z directions which is sufficiently smaller than a wavelength $\lambda_1$ or $\lambda_2$ corresponding to the resonant frequency of the resonator 11 or 12, so that it may be regarded that there would occur no ununiformity in a sound pressure distribution in those directions. Further, the opening portion 14 has an area So that is smaller than the sectional area Sp (i.e., $S_p>S_o$); that is, the sectional area Sp of each of the boundary surfaces 111 and 121 is greater than the area So of the opening portion 14.

The intermediate layer 13 is a space portion formed between the opening portion 14 and the resonators 11 and 12 and communicating directly with the opening portion 14. The intermediate layer 13 is a has layer comprising medium particles (i.e., gas molecules) that vibrate to cause sound waves to propagate. As illustrated in FIG. 3, the intermediate layer 13 is a portion of the interior hollow region that adjoins the opening portion 14 and communicates the resonators 11 and 12 with the opening portion 14. The intermediate layer 13 faces the resonator 11 via the boundary surface 111 and faces the resonator 12 via the boundary surface 121. The boundary surfaces 111 and 121 can each be regarded as a rectangular surface. Here, a medium via which sound waves propagate in the intermediate layer 13 is air, and a medium via which sound waves propagate in the interior hollow region 20 and in the external space is also air.

The opening portion 14, which communicates the hollow region 20 with the external space, has a square shape, each of the sides of which has a length d that is sufficiently smaller than the wavelengths $\lambda_1$ and $\lambda_2$ corresponding to the resonant frequencies of the resonators 11 and 12; for example, $d<\lambda_1/6$ and $d<\lambda_2/6$. When such a condition is satisfied, it may be regarded that there occurs no sound pressure distribution ununiformity in the intermediate layer 13 when sound waves of the wavelengths $\lambda_1$ and $\lambda_2$, corresponding to the resonant frequencies of the resonators 11 and 12, propagate in the intermediate layer 13 (i.e., when the resonators 11 and 12 resonate). Namely, when sound waves of the resonant frequencies of the resonators 11 and 12 propagate in the intermediate layer 13, sound pressure is distributed uniformly in the intermediate layer 13 without producing ununiformity in the sound pressure distribution. The reason why the sound pressure is distributed uniformly in the intermediate layer 13 is that there occurs almost no phase difference in the entire intermediate layer 13 because the dimension of the cross-section normal to the x-y plane of the interior hollow region 20 and the dimensions of the opening portion 14 are each sufficiently smaller than the wavelengths $\lambda_1$ and $\lambda_2$. Therefore, "there occurs no sound pressure distribution in the intermediate layer 13" (i.e., sound pressure is distributed uniformly) in the instant embodiment means that ununiformity in the sound pressure distribution is "zero". Further, "there occurs no sound pressure distribution in the intermediate layer 13" also means a situation where the dimension of the intermediate layer 13 is sufficiently smaller than sound wave lengths corresponding to the resonant frequencies and there is almost no ununiformity in the sound pressure distribution in the intermediate layer 13 and practically no sound pressure distribution in the intermediate layer 13 as noted above. If there is no ununiformity in the sound pressure distribution in the intermediate layer 13, a phase of reflected waves from the boundary surface 111 and a phase of reflected waves from the opening portion 14 coincide with each other in phase when the resonator 11 resonates, and reflected waves from the boundary surface 121 and reflected waves from the opening portion 14 coincide with each other in phase when the resonator 12 resonates.

Note that, where the opening portion 14 is not of a square shape, the "length d" may be construed as a length d of one side of an imaginary square having an area identical to the area So of the opening portion 14, or may be construed as a length d of one side on an inscribed rectangle of a diagram indicative of the shape of the opening portion 14.

Sound waves falling from the external space on the hollow member 10 arranged in the above-described manner (hereinafter referred to also as "incident waves") include those falling on the reflective surface 200 and those entering or falling in the opening portion 14. Of such incident waves, the waves entering or falling in the opening portion 14 enter the resonators 11 and 12 via the opening portion 14 and intermediate layer 13. If sound waves of the resonant frequencies of the resonators 11 and 12 are contained in the frequency bands of the incident waves, then the resonators 11 and 12 resonate in response to the incident waves, and there occurs a sound pressure distribution only in the extending direction of the interior hollow region 20 (i.e., in the y direction). Here, the wavelengths $\lambda_1$ and $\lambda_2$ corresponding to the resonant frequencies of the resonators 11 and 12 satisfy relationship represented by Mathematical Expression (1) below using the respective lengths $l_1$ and $l_2$, in the y direction, of the resonators 11 and 12, where n is an integral number equal to or greater than one and open end correction is ignored.

$$l_i=(2n-1)\lambda_i/4(_i=1,2) \quad (1)$$

As indicated in Mathematical Expression (1) above, each of the resonators 11 and 12, which is of a so-called closed tube type having an interior hollow region closed at one end and open at the other end, has the length $l_1$ or $l_2$ that is an odd multiple of a quarter of the wavelength $\lambda_1$ or $\lambda_2$ corresponding to the resonant frequency; thus, the lengths $l_1$ and $l_2$ are determined to achieve the intended resonant frequencies.

Figure 4:
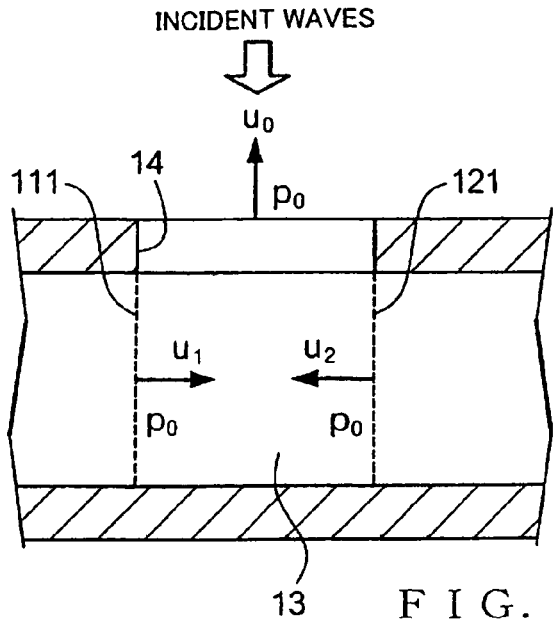
FIG. 4 is a sectional view explanatory of behavior of an intermediate layer when a resonator has resonated.

FIG. 4 is a sectional view explanatory of behavior of a portion of the interior hollow region 20 in the neighborhood of the opening portion 14 when the resonators 11 and 12 have resonated in response incident waves of predetermined frequency bands, containing the resonant frequencies of the resonators 11 and 12, falling on the hollow member 10.

In FIG. 4, sound pressure at the boundary surface 111 is indicated by $p_o$, and $u_1$ indicates a particle velocity of gas molecules acting on the boundary surface 111 in a direction normal to the boundary surface 111. Further, sound pressure at the boundary surface 121 is indicated by $p_o$, and $u_2$ indicates a particle velocity of gas molecules (i.e., motion velocity of medium particles) acting on the boundary surface 121 in a direction normal to the boundary surface 121. In the following description, the particle velocity $u_1$ at the boundary surface 111 is indicated in a positive value when the particle velocity acts in a direction from the resonator 11 to the intermediate layer 13, while the particle velocity $u_1$ at the boundary surface 111 is indicated in a negative value when the particle velocity acts in a direction from the intermediate layer 13 to the resonator 11. Further, the particle velocity $u_2$ at the boundary surface 121 is indicated in a positive value when the particle velocity acts in a direction from the resonator 12 to the intermediate layer 13, while the particle velocity $u_2$ at the boundary surface 121 is indicated in a negative value when the particle velocity acts in a direction from the intermediate layer 13 to the resonator 12. Namely, the particle velocity acting in the direction to the intermediate layer 13 is indicated in a positive value. If the resonators 11 and 12 of the hollow member 10 are constructed to have their lengths satisfying the condition of $l_1=l_2$, the particle velocity $u_2$ takes a positive value when the particle velocity $u_1$ takes a positive value at the time of resonance of the resonators 11 and 12, but takes a negative value when the particle velocity $u_1$ takes a negative value at the time of resonance. Namely, the particle velocities acting in the directions from the resonators 11 and 12 to the intermediate layer 13 vary in phase with each other.

Further, in FIG. 4, sound pressure at the opening portion 14, constituting a boundary between the intermediate layer 13 and the external space is indicated by $p_o$, and $u_o$ indicates a particle velocity of gas molecules acting in the opening portion 14 in a direction normal to the opening portion 14. The particle velocity acing in a direction from the opening portion 14 to the external space is indicated in a positive value, while the particle velocity acing in a direction from the external space to the opening portion 14 is indicated in a negative value. Here, the reason why the sound pressure at the boundary surfaces 111 and 121 and the opening portion 14 is of the same value $p_o$ is that the hollow member 10 is constructed in such a manner that almost no sound pressure distribution ununiformity occurs in the entire intermediate layer 13 when the resonators 11 and 12 have resonated.

If the sound pressure $p_o$ produced at the opening portion 14 in response to incident waves falling therein from the external space is defined by a mathematical expression of $p_o(t)=P_o\cdot\exp(j\omega t)$, the particle velocities $u_o$ and $u_2$ at the boundary surfaces 111 and 121 satisfy Mathematical Expression (2) below. Note that the sound pressure $p_o$ is a synthesis of the sound pressure of the incident waves and sound pressure of reflected waves produced in the intermediate layer 13 by resonance of the resonators 11 and 12.

$$u_i(t) = j\cdot\frac{P_0}{\rho c}\frac{\sin(kl_i)}{\cos(kl_i)}\cdot\exp(j\omega t)(i=1,2), \tag{2}$$

where j indicates an imaginary unit, $P_o$ indicates an amplitude value of the sound pressure, ω indicates an angular velocity, ρ c indicates a characteristic impedance of air that is the medium in the external space (ρ is a density of air, and c is a sound velocity in the air), k (=ω/c) indicates a wave number and t indicates time.

Further, because the intermediate layer 13 is a gas layer comprising gas molecules, it has "incompressibility" with an invariable volume. Namely, the intermediate layer 13 acts to keep its inner pressure constant so that its volume remains constant, although it elastically deforms due to the resonance. The intermediate layer 13 having such characteristics causes the sound pressure, acting from the resonators 11 and 12 via the boundary surfaces 111 and 121, to act directly on the opening portion 14, i.e. the boundary between the intermediate layer 13 and the external space. At that time, a sum between volume velocities acting on the intermediate layer 13 from the boundary surfaces 111 and 121 coincides with a volume velocity acting on the external space from the intermediate layer 13 via the opening portion 14.

Figures 5A, 5B:
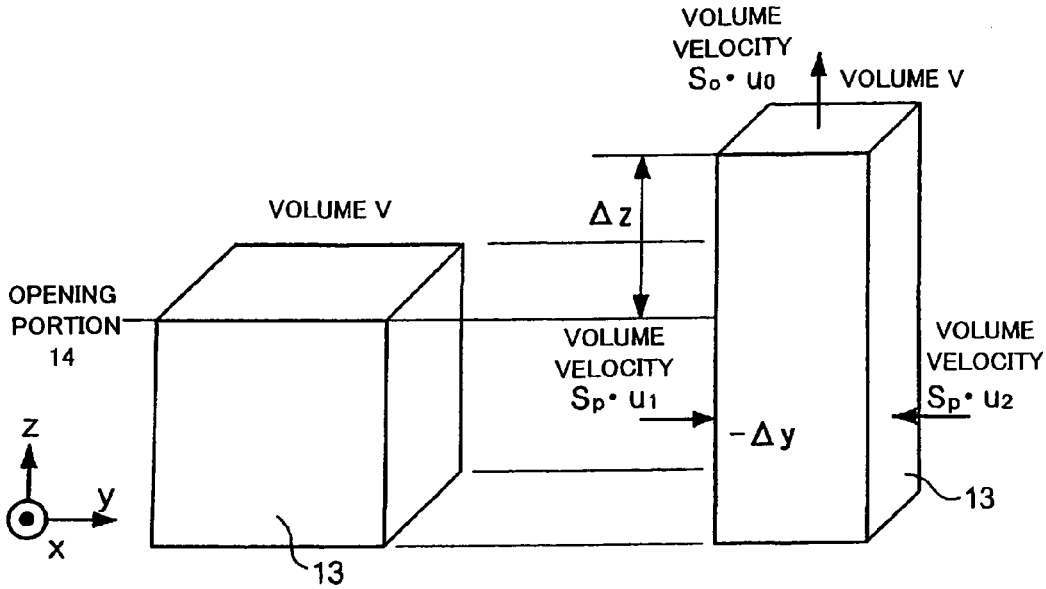
FIGS. 5A and 5B are diagrams explanatory of behavior of the intermediate layer at the time of resonance.

FIGS. 5A and 5B are diagrams explanatory of behavior of the intermediate layer 13 at the time of resonance when the particle velocities $u_1$ and $u_2$ are each of a positive value. When no incident wave is being received, the intermediate layer 13 has a volume V and a size and shape as shown in FIG. 5A. When the particle velocities $u_1$ and $u_2$ act in the positive direction at the time of resonance, the intermediate layer 13 assumes a state as shown in FIG. 5B. Namely, by the action of the particle velocities $u_1$ and $u_2$, the intermediate layer 13 decreases in dimension in the y direction by Δy and increases in dimension in the z direction by Δz. However, the intermediate layer 13 maintains the volume V because of its incompressibility. Namely, at the time of resonance, when the particle velocities $u_1$ and $u_2$ are each of a positive value, the particle velocity $u_0$ acting from the opening portion 14 on the external space takes a positive value, so that the intermediate layer 13 assumes a state as if it were projecting to the external space of the hollow member 10 via the opening portion 14. Namely, at the time of resonance, the volume velocities acting on the intermediate layer 13 from the resonators 11 and 12 are added up so that the sum between the volume velocities acts on the external space of the hollow member 10 via the intermediate layer 13. When the particle velocities $u_1$ and $u_2$ are each of a negative value, on the other hand, the particle velocity $u_0$ takes a negative value and acts in the direction from the opening portion 14 to the interior hollow region 20. Thus, the intermediate layer 13 increases in dimension in the y direction and decreases in dimension in the z direction. At that time, the particle velocity $u_0$ acting from the opening portion 14 on the external space takes a negative value, so that the intermediate layer 13 assumes a state as if it were retracting to the interior hollow region 20 via the opening portion 14.

If the particle velocities $u_1$ and $u_2$ shown in Mathematical Expression (2) are used, the particle velocity $u_0$ of the gas molecules, acting on the opening portion 14 in the z direction of the opening portion 14 (i.e., direction vertical to the reflective surface 200), satisfies relationship of Mathematical Expression (3) below.

$$u_0(t) = \frac{S_p}{S_0}(u_1(t)+u_2(t)) \tag{3}$$

As shown in Mathematical Expression (3) above, the particle velocity $u_0$ depends on an area ratio between the area $S_p$ of the boundary surfaces 111 and 121 and the area $S_o$ of the opening portion 14. If the resonators 11 and 12 have the same resonance frequency and the same sectional area in the direction vertical to the reflective surface 200, the particle velocity $u_1$ equals the particle velocity $u_2$. Thus, if relationship of $2S_p/S_o>1$ is satisfied and the area $S_p$ of the boundary surfaces 111 and 121 is greater than a half (½) of the area $S_o$ of the opening portion 14, a particle velocity $u_o$ much higher than a sum of the particle velocities $u_1$ and $u_2$ can be produced at the opening portion 14, as may also be seen from mathematic Expression (3) above.

Further, if Mathematical Expression (3) is used, a specific acoustic impedance ratio ξ when incident waves have fallen, from the external space, on the reflective surface 200 and the opening portion 14 of the hollow member 10 satisfies relationship defined in Mathematical Expression (4) below.

$$\xi = \frac{1}{\rho c}\frac{p_0(t)}{u_0(t)} = -j\cdot\frac{S_o}{S_p}\cdot\frac{\cos kl_1 \times \cos kl_2}{\sin k(l_1+l_2)} \tag{4}$$

As shown in Mathematical Expression (4) above, the specific acoustic impedance ratio ξ is a value calculated by dividing a specific acoustic impedance $p_o/u_o$ of the opening portion 14 by the characteristic impedance ρ c (specific acoustic resistance) of the medium (air) of the opening portion 14. In short, the specific acoustic impedance ratio ξ is a ratio between a specific acoustic impedance of a given point in a sound field and a characteristic impedance of the medium at that point. Once incident waves belonging to the resonant frequencies fall in the opening portion 14 in the direction normal thereto, reflected waves produced by the resonance of the resonators 11 and 12 are radiated to the external space via the intermediate layer 13 and opening portion 14 in accordance with an intensity of the specific acoustic impedance ratio ξsatisfying the relationship defined in Mathematical Expression (4). Here, the specific acoustic impedance ratio ξ=r+jx. "r" indicates a real part of the specific acoustic impedance ratio ξ (i.e., Re (ξ), which is a value sometimes called "specific acoustic resistance ratio". "x" indicates an imaginary part of the specific acoustic impedance ratio ξ (i.e., Im(ξ), which is a value sometimes called "specific acoustic reactance ratio".

The following describe relationship between the specific acoustic impedance ratio ζ and reflected waves from the acoustic structure 1.

(I) In the case where ζ=0, namely, r=0 and x=0:

Once incident waves fall on a material satisfying ζ=0 (r=0 and x=0), reflected waves having the same amplitudes as the incident waves and phase-displaced by 180 degrees from the incident waves are radiated as reflected waves produced through resonance. In this way, the incident waves and the reflected waves interfere with each other so that the respective amplitudes of the incident waves and the reflected waves cancel out each other. Such resonance will hereinafter be referred to as "full resonance".

(II) In the case where ζ=1, namely, r=1 and x=0:

Once incident waves fall on a material satisfying ζ=1 (r=1 and x=0), no reflected wave is radiated from the material. Such a phenomenon will hereinafter be referred to as "full sound absorption".

(III) In the case where ζ=∞, namely, r=∞ and x=0:

Once incident waves fall on a region satisfying ζ=∞ (r=∞ and x=0) (i.e., rigid material), reflected waves having the same amplitudes as the incident waves and having no phase displacement (zero-degree phase displacement) from the incident waves are radiated as reflected waves produced through resonance. In this case, the incident waves and the reflected waves interfere with each other in such a manner that standing waves are produced. Such resonance will hereinafter be referred to as "full reflection".

Item (I) above indicates a case where r=0 and the hollow member 10 does not have a resistance component; however, the hollow member 10 may sometimes have some resistance component. In this case, once sound waves of the resonant frequencies of the resonators 11 and 12 enter the opening portions, the real part of the specific acoustic impedance ratio ζ may sometimes take a value other than 0 (zero). At that time, reflected waves radiated from the opening portion 14 attenuate in amplitude depending on the resistance component of the hollow member 10. Namely, it may be regarded that a "resonance phenomenon", where the resonators radiate resonance-based reflected waves in a case where a condition of "0≦ζ<1" is satisfied as well as in the case of the "full resonance" where the specific acoustic impedance ratio ζ of the opening portion 14 takes the value "0".

A specific acoustic impedance ratio ξ=r+jx and a complex sound pressure reflection coefficient R=|R|exp(jϕ) at a point on a region of a certain member satisfies relationship of "R=(ξ−1)/(ξ+1)". The complex sound pressure reflection coefficient is a physical amount indicative of a complex number ratio between reflected waves and incident waves at a point of a space. |R| is a value indicative of a level of an amplitude of the reflected waves relative to the incident waves. A greater value of |R| indicates that the reflected waves have a greater amplitude. "ϕ" is a value indicative of a level of phase variation (hereinafter "phase variation amount") of the reflected waves relative to the incident waves. As apparent from the relational expression, as one of the specific acoustic impedance ratio ξ and the complex sound pressure reflection coefficient R is determined, the other of the specific acoustic impedance ratio ξ and the complex sound pressure reflection coefficient R is determined. When ξ=0 (i.e., full resonance), R=−1, in which case the reflected waves are opposite in phase from the incident waves and have the same amplitude as the incident waves. When ξ=i (i.e., full sound absorption), R=0, in which case no reflected waves are radiated and hence the amplitude of the reflected waves is 0 (zero). When ξ=∞ (i.e., full reflection), R=1, in which case the reflected waves are in phase with the incident waves and have the same amplitude as the incident waves.

The following describe sound absorbing and sound scattering effects achieved by the resonance phenomenon, both in terms of the phase and in terms of the amplitude.

First, the sound absorbing and sound scattering effects achieved by the resonance phenomenon will be discussed in terms of the phase.

Figure 6:
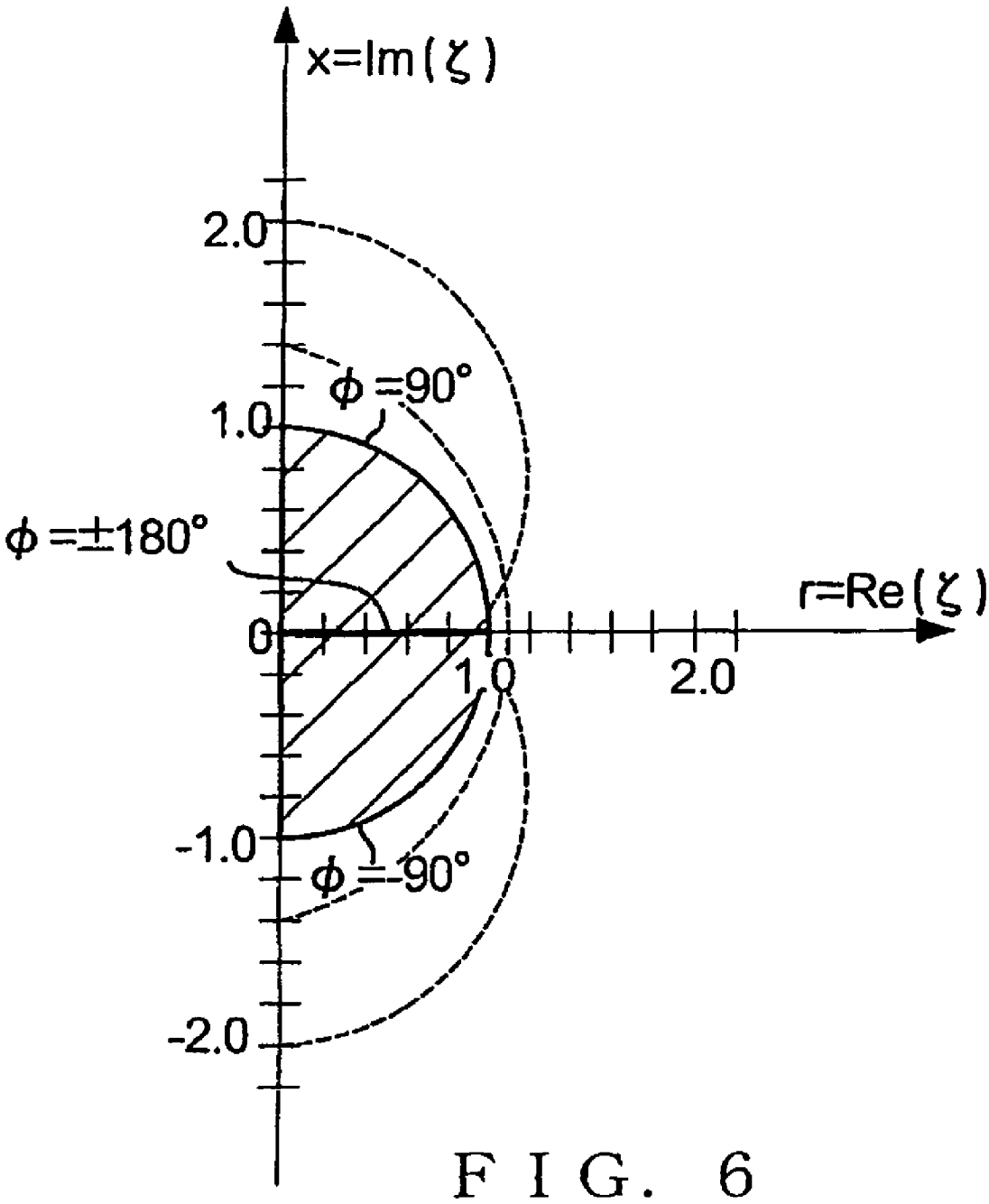
FIG. 6 is a graph showing relationship between a specific acoustic impedance ratio $\zeta$ and a phase variation amount $\phi$.

FIG. 6 is a graph showing relationship between the specific acoustic impedance ratio ζ and the phase variation amount ϕ. In this graph, the horizontal axis represents the real part, r=Re(ζ), of the specific acoustic impedance ratio ζ, while the vertical axis represents the imaginary part, x=Im(ζ) of the specific acoustic impedance ratio ζ. In FIG. 6, at a point where ζ=∞, a distance from the original point is ∞. At that time, there occurs the full reflection so that the phase variation amount ϕ is 0°.

Further, in a hatched region of FIG. 6, |ζ|<1, and the phase variation amount ϕ is greater than 90°. If such conditions are met, the phase variation amount ϕ approaches ±180° as the value |ζ| decreases. More specifically, the phase variation amount ϕ approaches 180° if x=Im(ζ)>0, but it approaches −180° if x=Im(ζ)<0. Further, at a point on the horizontal axis where 0≦Re(ζ)<1 and Im(ζ)=0, there occurs the full resonance so that the phase variation amount ϕ is ±180°. Namely, particularly, where the specific acoustic impedance ratio ζ are of values represented in a region inside a circle having a radius of "1" about the original point (however, no region just on the line is included) within the hatched region of FIG. 6, there can be effectively achieved a sound absorbing effect by virtue of phase interference between the incident waves and the reflected waves. Further, in a region where the value of $|\zeta|$ is equal to or greater than "1", the phase variation amount $\phi$ is smaller than 90°. In such a region, there can be achieved a sound absorbing effect by virtue of phase interference, which is however less than that achieved where the value of $|\zeta|$ is less than "1". Regarding the sound scattering effect, on the other hand, there can be achieved a sound scattering effect if there is a phase difference between reflected waves radiated from the opening portion 14 and reflected waves radiated from the reflective surface 200; it is considered that a more noticeable sound scattering effect can be achieved as the phase of the reflected waves radiated from the opening portion 14 and the phase of the reflected waves radiated from the reflective surface 200 approach opposite-phase relationship. Namely, a sound scattering effect is achievable where the value of $|\zeta|$ is equal to or greater than "1"; for that purpose, it is preferable that the condition of "$|\zeta|<1$" is met, and it is more preferable that the value of $|\zeta|$ is closer to "0" and hence the phase variation amount $\phi$ is closer to ±180°.

As seen from the foregoing, it is ideal that the condition of "$\mathrm{Im}(\zeta)=0$" is met so as to attain the condition of "$\phi=\pm180°$" in a resonance phenomenon intended for achieving sound absorbing and scattering effects. However, such sound absorbing and scattering effects are achievable as long as the relationship of "$90°\leqq\phi\leqq180°$" or "$-180°\leqq\phi\leqq-90°$ is satisfied, i.e. the value of $|\zeta|$ is less than "1". Further, where the value of $|\zeta|$ is less than "1", it is more preferable that the condition of "$135°\leqq\phi\leqq180°$" or "$-180°\leqq\phi\leqq-135°$" be satisfied, and it is even more preferable that the condition of "$160°\leqq\phi\leqq180°$" or "$-180°\leqq\phi\leqq-160°$" be satisfied.

Next, the sound absorbing and sound scattering effects achieved by the resonance phenomenon will be discussed in terms of the amplitude.

Figure 7:
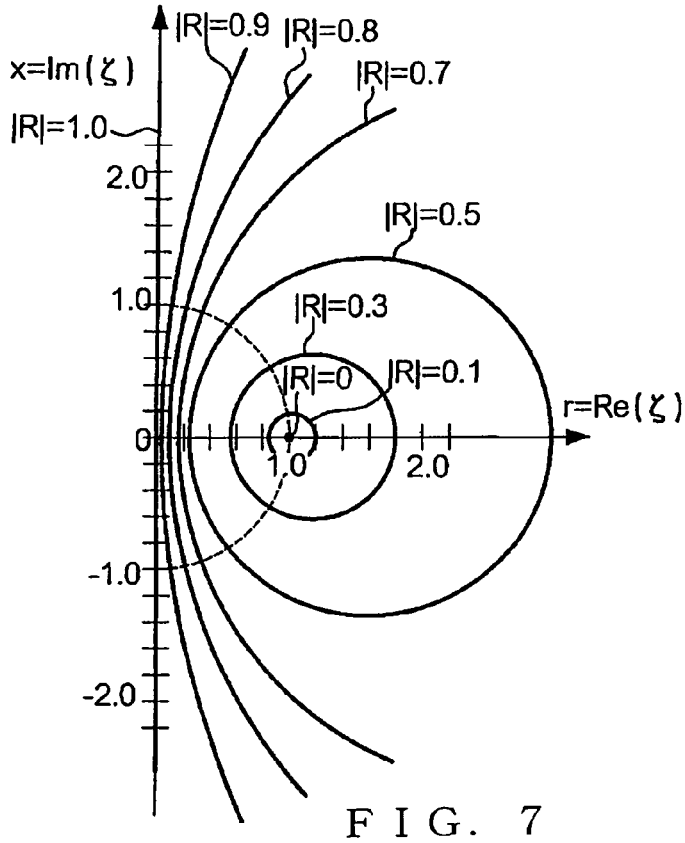
FIG. 7 is a graph showing relationship between the specific acoustic impedance ratio $\zeta$ and an amplitude $|R|$ of a complex sound pressure reflection coefficient.

FIG. 7 is a graph showing relationship between the specific acoustic impedance ratio $\zeta$ and the amplitude $|R|$ of the complex sound pressure reflection coefficient. More specifically, in the graph, values of $\mathrm{Re}(\zeta)$ and $\mathrm{Im}(\zeta)$ are shown when the value of $|R|$ takes values of 0.0, 0.1, 0.3, 0.5, 0.7, 0.8, 0.9 and 1.0, respectively. As shown in FIG. 7, where $\mathrm{Re}(\zeta)=1$ and $\mathrm{Im}(\zeta)=0$, $|R|=0$, and thus, the amplitude takes a minimal value of "0". Namely, in this case, the full sound absorption is occurring with no reflected waves produced.

A region defined by broken line in FIG. 7 represents the region where $|\zeta|=1$ explained above in relation to FIG. 6. In a region inside the broken-line-defined region (however, no region just on the line is included), there are phase differences in a range of 90°-180° between incident waves and reflected waves. Also, in this region, $|R|>0$, and thus the amplitude of the reflected waves exceeds "0".

At a point on the vertical axis of FIG. 7, where $\mathrm{Re}(\zeta)=0$, the value of $|R|$ becomes "1.0" independently of the value of $\mathrm{Im}(\zeta)$. Because reflected waves having the same amplitude as the incident waves are radiated at that time, this condition is most preferable, from the viewpoint of the amplitude, for achieving sound absorbing and scattering effects in a condition where the reflected waves and the incident waves differ in phase from each other. As seen from FIG. 7, in a case where $\mathrm{Re}(\zeta)<1$, the value of $|R|$ increases as the value of $\mathrm{Re}(\zeta)$ decreases, if the value of $\mathrm{Im}(\zeta)$ is kept constant. Namely, if the value of the real part $\mathrm{Re}(\zeta)$ of the specific acoustic impedance ratio $\zeta$ is small, particularly almost "0", the reflected waves have a great amplitude irrespective of the value of $\mathrm{Im}(\zeta)$, and thus, there can be effectively achieved sound absorbing and scattering effects by virtue of phase interference.

In the hollow member 10, the opening portion 14 is connected to the resonators 11 and 12 via the intermediate layer 13 as noted above. Thus, "$\mathrm{Im}(\zeta)<1$" is met in the opening portion 14 in the neighborhood of the neighborhood of the respective resonant frequencies of the resonators 11 and 12. Thus, in this case, the phase of the reflected waves from the opening portion 14 is displaced more than 90° relative to the phase of the incident waves. If $\mathrm{Re}(\zeta)=0.30$, the amplitude $|R|$ of the reflected waves is 0.54, and thus, reflected waves of an amplitude that is equal to or greater than a half (½) of the amplitude of the incident waves are radiated. Namely, if $\mathrm{Re}(\zeta)$ and $\mathrm{Im}(\zeta)$ of the opening portion 14 of the opening portion 14 are both sufficiently small, there can be obtained, from the opening 14, reflected waves having a sufficiently great and great phase variation as compared to those of reflected waves from a region of the reflective surface 200 near the opening portion 14. Whereas it can be said to be ideal if the full resonance is achieved where incident waves and reflected waves become identical to each other in amplitude by the condition of "$|R|=1.0$" when $\mathrm{Re}(\zeta)=0$ and $\mathrm{Im}(\zeta)=0$. The following discuss a case where $|R|$ is less than one.

When $|R|=0.5$, for example, energy of about ¼ of incident energy is radiated from the opening portion 14, and thus, in this case too, sound absorbing and scattering effects can be achieved in an even more efficient manner. For example, when $\mathrm{Im}(\zeta)=0$, $\mathrm{Re}(\zeta)\approx0.335$, and the value of the real part of the specific acoustic impedance ratio becomes equal to or less than about 139.025 $kg/m^2\cdot sec$. It is more preferable that a condition of "$|R|=0.7$" be satisfied, in which case energy of about ½ of incident energy is radiated from the opening portion 14, so that even further enhanced sound absorbing and scattering effects can be achieved. For example, when $\mathrm{Im}(\zeta)=0$, $\mathrm{Re}(\zeta)\approx0.175$, and the value of the real part of the specific acoustic impedance ratio becomes equal to or less than about 72.625 $kg/m^2\cdot sec$. It is more preferable that a condition of "$|R|=0.9$" be satisfied, in which case energy of about ⅘ of incident energy is radiated from the opening portion 14, so that even more noticeable sound absorbing and scattering effects can be achieved. For example, when $\mathrm{Im}(\zeta)=0$, $\mathrm{Re}(\zeta)\approx0.055$, and the value of the real part of the specific acoustic impedance ratio becomes equal to or less than about 22.825 $kg/m^2\cdot sec$.

Further, if $|R|\geqq0.7$ which is a preferable condition is met, $\mathrm{Re}(\zeta)$ becomes equal to or less than about 0.175 as shown in FIG. 7. Furthermore, if $|R|\geqq0.9$ which is a more preferable condition is met, $\mathrm{Re}(\zeta)$ becomes equal to or less than about 0.055. As can be appreciated from these results, constructing the acoustic structure of the present invention in such a manner that the value of $\mathrm{Re}(\zeta)$ becomes almost "0" (zero) is preferable to achieve good sound absorbing and scattering effects.

As also seen from Mathematical Expression (4) above, the absolute value $|\zeta|$ of the specific acoustic impedance ratio $\zeta$ can be varied by varying the area ratio $S_o/S_p$ (rs) between the area $S_p$ of the boundary surfaces 111 and 121 and the area $S_o$ of the opening portion 14.

Figure 8:
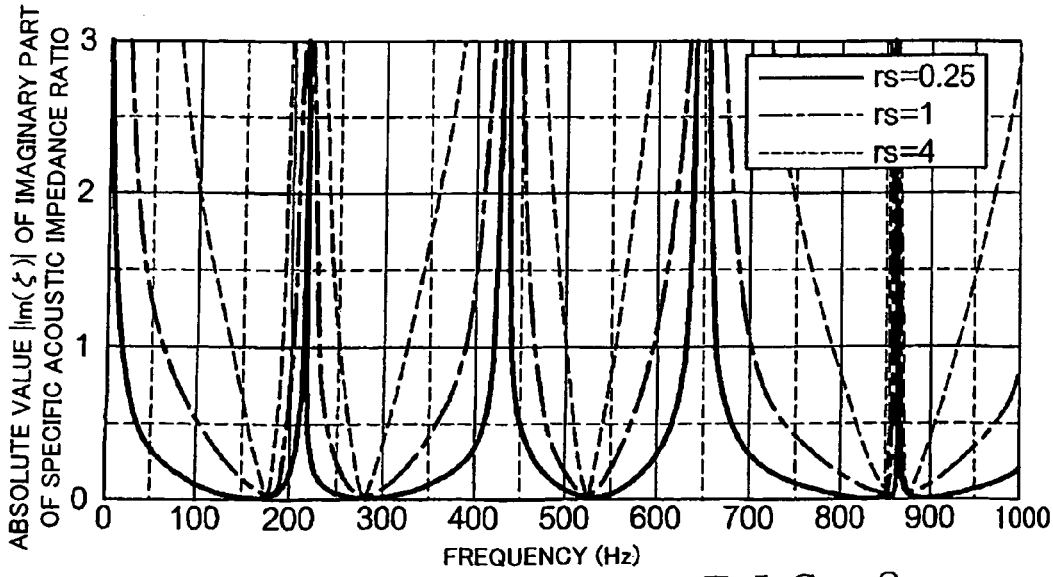
FIG. 8 is a graph showing frequency characteristics of an absolute value of an imaginary part of the specific acoustic impedance ratio $\zeta$.

FIG. 8 is a graph showing frequency characteristics of the absolute value $|\mathrm{Im}(\zeta)|$ of the imaginary part of the specific acoustic impedance ratio $\zeta$ when $l_1=300$ mm and $l_2=485$ mm. More specifically, FIG. 8 shows calculated values of $|\mathrm{Im}(\zeta)|$ when rs=0.25, 1.0 and 4.0, respectively.

The reason why $|\mathrm{Im}(\zeta)|$ is shown here is that the relationship of "$90°\leqq\phi\leqq180°$" or "$-180°\leqq\phi\leqq-90°$ is established in a range where $|\mathrm{Im}(\zeta)|<1$ and thus visually showing such a range should be helpful. A condition of "$|\mathrm{Im}(\zeta|=\infty$" occurs when anti-resonance occurs at a given frequency, and the value of Im(ζ) takes opposite signs (i.e., plus and minus signs) at opposite sides of the given frequency.

As seen from FIG. 8, frequency bands where "0≦|Im(ζ)|<1" is established become wider as the area $S_p$ of the boundary surfaces 111 and 121 increases relative to the area $S_o$ of the opening 14, i.e. as the area ratio $S_o/S_p$ (rs) decreases. Further, as the area ratio (rs) decreases, an area of a region surrounded by a linear line of "Im(ζ)=1.0" and a curve representing Im(ζ) becomes greater. Namely, in accordance with the incident waves entering or falling in the opening portion 14, frequency bands where it can be regarded that a resonance phenomenon occurs become wider, and a resonance phenomenon close to the full resonance (ζ=0) appears over wider frequency bands.

Further, if the area ratio rs is smaller than 1.0, the aforementioned effects can be enhanced as compared to those achieved by a conventionally-known acoustic cylinder where the area ratio rs is, for example, 1.0. The inventor etc. of the present invention has confirmed that it is more preferable to employ a condition of "rs≦0.5" because, in such a case, the area of the above-mentioned region increases by a factor of about 1.2 as compared to that of the conventionally-known acoustic cylinder and the value of |Im(ζ)| decreases to less than about a half of that of the conventionally-known acoustic cylinder. It is more preferable to employ a condition of "rs≦0.25" because the area of the above-mentioned region increases by a factor of about 1.5 as compared to that of the conventionally-known acoustic cylinder and the value of |Im(ζ)| decreases to less than about a quarter of that of the conventionally-known acoustic cylinder.

As set forth above, the acoustic structure 1 can effectively achieve good sound absorbing and scattering effects by virtue of a resonance phenomenon by setting the area ratio rs such that the absolute value |ζ| of the specific acoustic impedance ratio in the opening portion 14 becomes less than one (|ζ|<1) and the real part r of the specific acoustic impedance ratio ζ becomes almost zero ("0").

In the hollow member 10, no component element, such as a resistance element, that would disturb movement and motion of the gas (medium) is provided in the intermediate layer 13 and opening portion 14. Further, by the setting of the area ratio rs, it is possible to produce, in the opening portion 14, a particle velocity greater than a sum of particle velocities produced on the boundary surfaces 111 and 112 by resonance of the resonators 11 and 12. In this way, there can be achieved an extremely preferable condition that the real part r of the specific acoustic impedance ratio ζ becomes almost zero. It is ideal that the real part r of the specific acoustic impedance ratio ζ be zero, as noted above. However, even in the case where the real part r of the specific acoustic impedance ratio ζ is not exactly zero, not only sound absorption can be achieved by virtue of phase interference in a sound absorbing region in the neighborhood of the opening portion 14, but also sound scattering cab be achieved by virtue of a great particle velocity produced in and around the sound absorbing region.

It should be appreciated that the aforementioned conditions for allowing the real part r of the specific acoustic impedance ratio ζ to become almost zero are merely illustrative examples.

Figure 9A:
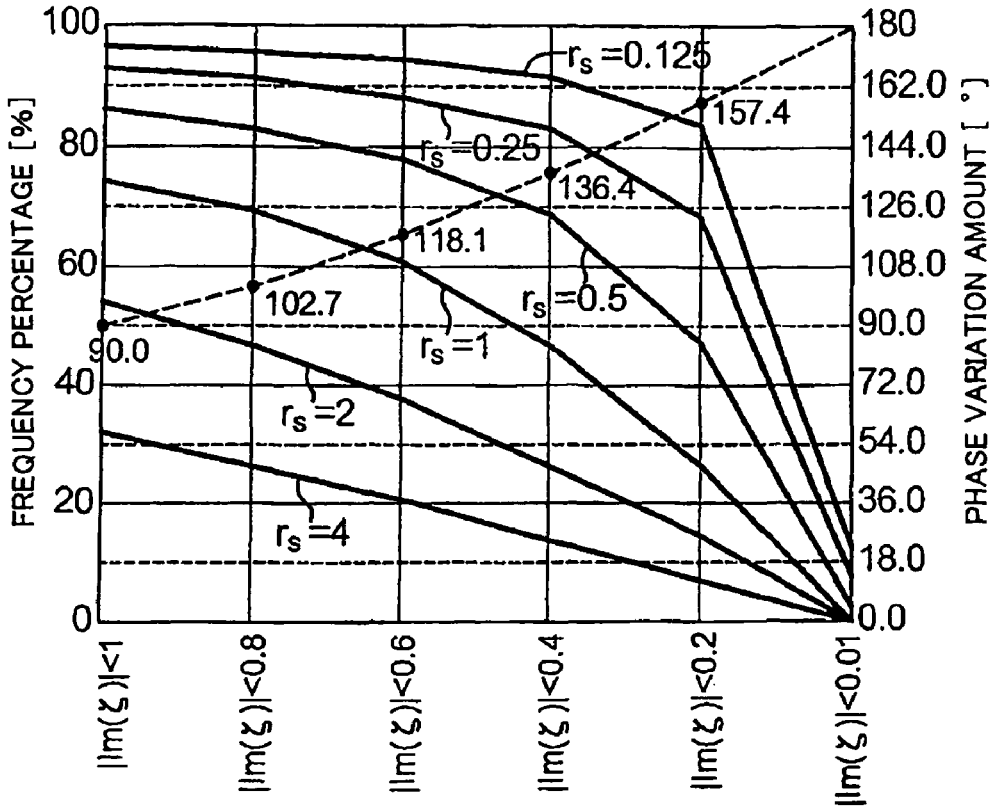
FIGS. 9A and 9B are graphs showing relationship between a frequency percentage and an area ratio rs where $|\mathrm{Im}(\zeta)|$ falls below a given value.
Figure 9B:
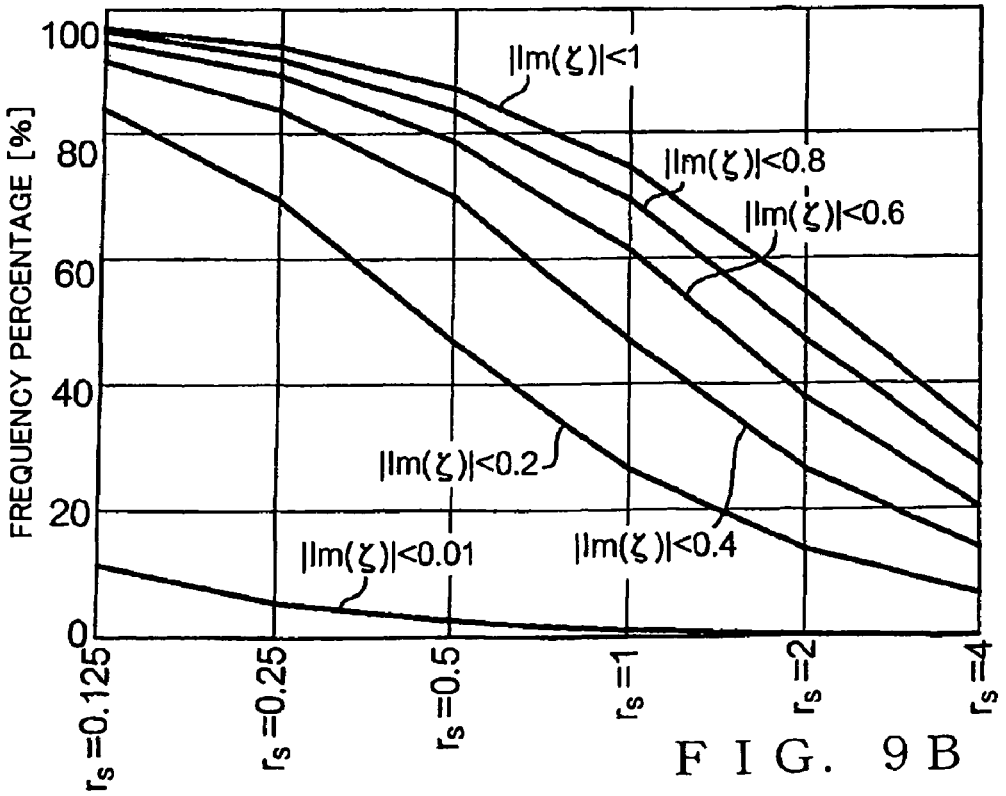

FIGS. 9A and 9B show relationship between a frequency percentage and the area ratio rs where |Im(ζ)| falls below a given value in frequency bands from 0 Hz to 1,000 Hz. More specifically, FIG. 9A is a graph where the horizontal axis represents |Im(ζ)| while the vertical axis represents the frequency percentage (%) and phase variation amount (°). FIG. 9B is a graph where the horizontal axis represents the area ratio rs while the vertical axis represents the frequency percentage (%). In FIG. 9A, a broken line indicates a lower limit of the phase variation of reflected waves per value of |Im(ζ)|. The "frequency percentage" is a percentage of a bandwidth where |Im(ζ)| takes given values relative to an overall bandwidth of the frequency bands from 0 Hz to 1,000 Hz. Let it be assumed here that the given values of |Im(ζ)| are 0.1, 0.2, 0.4, 0.6, 0.8 and 1.0.

Also note that, in FIGS. 9A and 9B, calculated results when Re(ζ)=0 are shown; in this case too, $l_1$=300 mm and $l_2$=485 mm.

As apparent from FIG. 9A, a percentage with which the phase variation amount of the reflected waves becomes equal to or greater than the given value increases as the area ratio rs decreases (i.e., the area of the opening portion 14 decreases). If rs=0.25, for example, the frequency percentage with which the value of |Im(ζ)| is smaller than "0.2" is about 70%, and, in the case of the conventionally known scheme where rs=1.0, the frequency percentage is about 27%. From these results, it can be seen that the frequency percentage when the phase variation amount is, for example, equal to or greater than 157.5° is about three time greater than that of the conventionally known scheme. Further, the frequency percentage with which Im(ζ)| is less than a given value increases as the area ratio rs decreases.

From the results of FIGS. 9A and 9B too, it can be seen that frequency bands where the phase variation amount of reflected waves increases as the area ratio rs decreases become greater.

The following describe behavior of the acoustic structure 1 for achieving sound absorbing and scattering effects.

Figure 10:
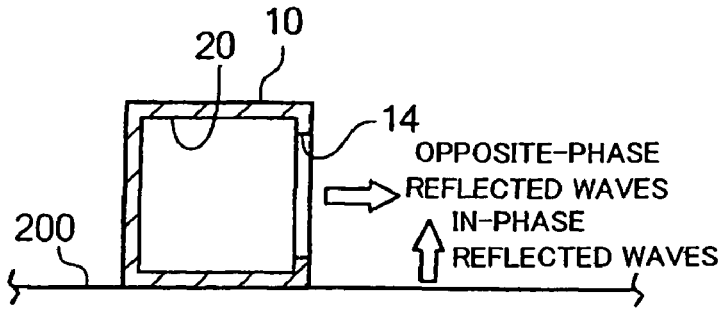
FIG. 10 is a view explanatory of reflected waves produced by resonance and radiated via an opening portion of a hollow member and reflected waves radiated from a reflective surface.

FIG. 10 is a view explanatory of reflected waves produced by resonance and radiated via the opening portion 14 of the hollow member 10 and reflected waves radiated from the reflective surface 200. Once incident waves of the resonant frequencies of the resonators 11 and 12 fall in the opening portion 14, the opening portion 14 radiates reflected waves different in phase from the incident waves. If ζ=0, reflected waves opposite in phase from the incident waves (i.e., opposite-phase reflected waves) are radiated from the opening portion 14. If the reflective surface 200 is a rigid surface (ζ=∞), then the reflective surface 200 radiates reflected waves in phase with the incident waves (i.e., in-phase or same-phase reflected waves). Further, because the opening portion 14 and the reflective surface 200 are in non-parallel relation to each other, the reflected waves from these surfaces 14 and 200 travel in such a way to intersect and interfere with each other in a space near the opening portion 14 and reflective surface 200.

Figure 11:
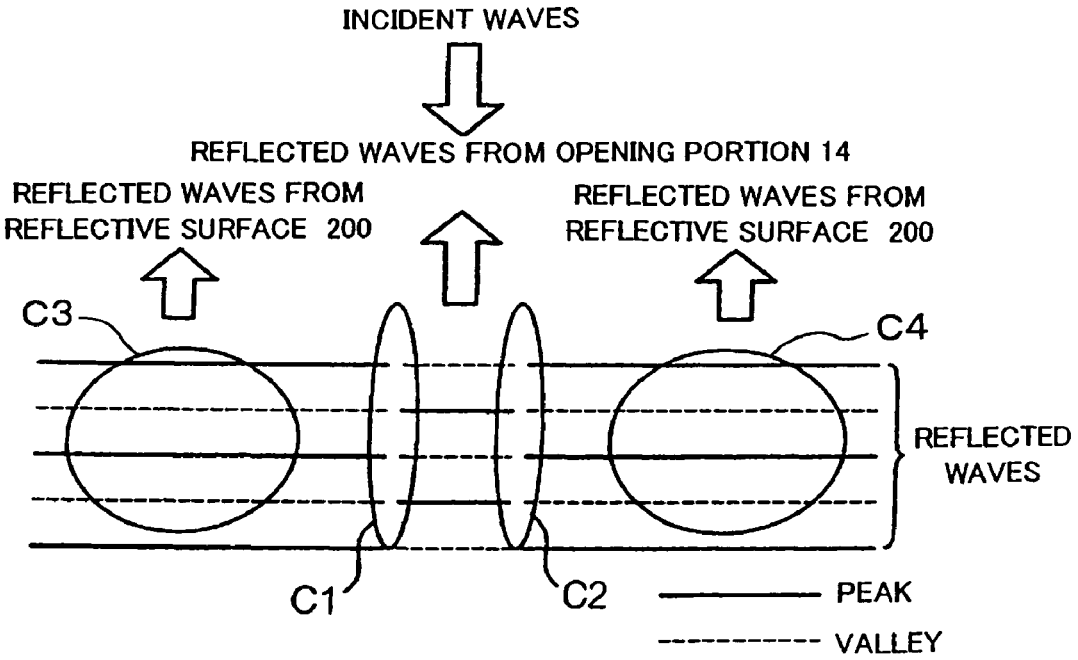
FIG. 11 is a view explanatory of behavior of reflected waves in and around the opening portion of the hollow member at the time of resonance.

The following describe in more detail behavior of the acoustic structure 1 pertaining to sound absorption and sound scattering. FIG. 11 is a view explanatory of behavior of reflected waves in the neighborhood of the opening portion 14 of the hollow member 11 at the time of resonance. In FIG. 11, the reflected waves from the reflective surface 200 and the opening portion 14 are shown as traveling in the same direction, for ease of explanation. Note that similar phenomena to those shown in FIG. 11 occur even in a case where the reflected waves from the reflective surface 200 and the opening portion 14 travel in such a way as to intersect with each other. More particularly, FIG. 11 shows that peaks of incident waves where sound pressure is maximal arrive at the reflective surface 200 and the opening portion 14 and then reflected waves corresponding to the incident waves are generated. Let it be assumed here that the specific acoustic impedance ratio ζ of the opening portion 14 is zero (ζ=0) and thus the above-mentioned "full resonance" occurs. Further, in the figure, the reflected waves are depicted by solid and broken lines; each of the solid lines depicts a position of a peak where the sound pressure of the reflected waves is maximal, while each of the broken lines depicts a position of a valley where the sound pressure of the reflected waves is minimal (and which assumes an opposite phase to the "peak").

Once incident waves of the resonant frequencies fall in the opening portion 14 of the hollow member 10, reflected waves phase-displaced by 180 degrees from the incident waves are radiated in the z direction from the opening portion 14, as reflected waves produced through resonance. Thus, as shown in the figure, the reflected wave at the opening portion 14 is of a valley phase where the sound pressure is minimal. Because the hollow member 10 is formed of a material having a relatively high rigidity coefficient as noted above, the hollow member 10 has a considerably great specific acoustic impedance ratio. Therefore, the reflected waves radiated from the reflective surface 200 have almost no phase displacement from the incident waves (see regions C3 and C4). If the reflective surface 200 is a rigid surface, then the above-mentioned "full reflection" occurs, and thus, the reflected waves radiated from the reflective surface 200 have the same phase as the incident waves with zero phase displacement from the incident waves. Namely, the full resonance occurs when the specific acoustic impedance ratio $\zeta$ of the opening portion 14 is zero, and when the full reflection has occurred with the specific acoustic impedance ratio of $\infty$, the reflected waves from the opening portion 14 and the reflected waves from the reflective surface 200 share the same amplitude and are phase shifted from each other by 180 degrees. Thus, there occurs a phenomenon, in the external spaces near the opening portion 14 and reflective surface 200, where the phases of the reflected waves from the opening portion 14 and the reflected waves from the reflective surface 200 become discontinuous in mutually-adjacent regions (spaces) C1 and C2 as depicted in two ellipses in FIG. 11.

Because of the aforementioned phenomenon, a sound absorbing effect can be achieved primarily in a sound absorbing region formed in the neighborhood of the opening portion 14 by virtue of a resonant phenomenon. A sound scattering effect, on the other hand, can be achieved primarily around the sound absorbing region through interaction between phase interference between the incident waves falling on the reflective surface 200 and the reflected waves and phase interference between the incident waves falling in and around the opening portion 14 and reflected waves produced by resonance. More specifically, it may be considered that the sound scattering effect can be achieved by flows of gas molecules being produced in and around the opening portion through the aforementioned interaction. Namely, the reflected waves from the opening portion 14 and the reflected waves from the reflective surface 200 differ from each other in phase angle, and phenomena differing from one another due to the phase difference occur in adjoining spaces, i.e. regions C1-C4. Thus, it can be deemed that, according to the acoustic structure 1 of the present invention, acoustic phenomena for achieving the sound absorbing and sound scattering effects can occur simultaneously.

Further, as seen from the relationship defined in Mathematical Expression (3) above, the particle velocity $u_0$ at the opening portion 14 increases as the area $S_p$ of the boundary surfaces 111 and 121 increases as compared to the area $S_o$ of the opening portion 14, i.e. as the area ratio $S_o/S_p$ decreases. Thus, by the relationship of $2S_p>S_o>1$ being satisfied, vibration of the gas molecules further increases in and around the opening portion 14, so that the sound scattering and sound absorbing effects can be further enhanced in the external space near the opening portion 14. As explained above, high sound scattering and sound absorbing effects can be achieved in the external space near the opening portion 14 by the phase difference between the reflected waves from the reflective surface 200 and the reflected waves from the opening portion 14.

Further, as seen from the relationship defined in Mathematical Expression (4) above, the specific acoustic impedance ratio $\zeta$ depends on the size of the intermediate layer 13, and thus, the phase difference relationship between the reflected waves from the reflective surface 200 and the reflected waves from the opening portion 14 too depends on the area ratio $S_o/S_p$. In an ideal state where no ununiformity in the sound pressure distribution occurs in the intermediate layer 13 when the reflective surface 200 achieves the full reflection and the resonators 11 and 12 achieve the full resonance, the reflected waves from the reflective surface 200 and the reflected waves from the opening portion 14 are placed in opposite-phase relationship. Further, even when there is a minute ununiformity in the sound pressure distribution in the intermediate layer 13, the sound scattering and sound absorbing effects can be achieved by virtue of the aforementioned actions as long as the intermediate layer 13 is constructed in such a manner that the reflected waves from the reflective surface 200 and the reflected waves from the opening portion 14 are placed in substantial opposite-phase relationship.

In the aforementioned manner, the acoustic structure 1 is constructed by arranging the hollow member 10 in such a manner that the opening portion 14 is located close to the reflective surface 200.

In the instant embodiment, the feature that the opening portion 14 is located "close to" the reflective surface 200 may be construed as referring to a particular distance between the reflective surface 200 and the opening portion 14 within which, when the reflective surface 200 radiates reflected waves in response to incident waves falling thereon from the external space, the resonators 11 and 12 resonate as a result of the incident waves also falling into the opening portion 14, and within which the reflected waves from the reflective surface 200 and the reflected waves from the opening portion 14 interfere with each other. The hollow member 10 is preferably positioned such that the opening portion 14 is located within such a distance from the reflective surface 200 as to cause the aforementioned acoustic phenomena.

With the above-described acoustic structure 1 of the present invention, a sound scattering effect is achieved by flows of motion energy of gas molecules being produced in an oblique direction, not normal to the reflective surface 200, through phase interference between the incident waves falling on the reflective surface 200 and the reflected waves and phase interference between the incident waves falling in and around the opening portion 14 and reflected waves produced by resonance, phase interference between the incident waves falling on the reflective surface 200 and the reflected waves. Further, a sound absorbing effect is achieved by the reflected waves from the opening portion 14 canceling out, in the external space near the opening portion 14, the amplitude of the incident waves into the opening portion 14 by virtue of a phase difference through a resonance phenomenon. As a consequence, sound absorbing and scattering effects can be achieved over wide frequency bands in a wide region in the neighborhood of the opening portion 14. Particularly, if the relationship "$S_p>S_o$" is satisfied, the specific acoustic impedance ratio $\zeta$ in the opening portion 14 can decrease even further, so that the frequency bands over which the sound absorbing effect can be achieved can be even further widened, with the result that the sound absorbing and scattering effects can be enhanced even further.

Further, the acoustic structure 1 of the present invention has a considerably small dimension in its thickness direction (i.e., z direction) as compared to the wavelengths of the resonant frequencies and thus does not narrow the acoustic space where the acoustic structure is disposed. Further, because the acoustic structure 1 can be constructed by merely providing the elongated, tubular hollow member 10 on the existing reflective surface 200, such as a ceiling, wall surface or floor surface, of the acoustic space, it can be constructed and installed with utmost ease without its installed position being substantially limited. Further, the reflective surface 200 only need be formed of a reflective material and the hollow member 10 itself need not have reflectiveness, so that the present invention can provide an expanded range of options in choosing materials of the acoustic structure 1. Furthermore, the acoustic structure 1 is constructed to achieve a sound absorbing effect by causing a high particle velocity without using a member, such as a resistance material, that constrains vibration of gas molecules, and it can achieve a superior sound absorbing effect at positions of the reflective surface 200 remote from the opening portion 14.

—Modification—

The acoustic structure 1 of the present invention may be implemented in different manners from the above-described preferred embodiment like the following modifications, and these modifications may be combined as desired. Note that elements similar in construction to those in the above-described preferred embodiment are represented using combinations of the same reference numerals as used for the preferred embodiment and alphabetical letters "a" to "h" and will not be described here to avoid unnecessary duplication. Note that the ceiling, wall surface and floor surface, constituting the acoustic room, are each formed of a reflective material and correspond to the reflective surface 200 of the above-described preferred embodiment.

(Modification 1)

Figure 12:
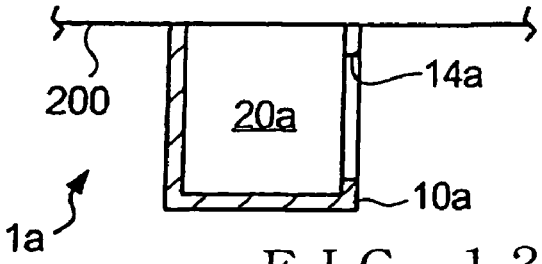
FIG. 12 is a sectional view of a first modified acoustic structure.

The interior hollow region 20 is provided in the interior of the hollow member 10 of a rectangular sectional shape in the above-described preferred embodiment of the acoustic structure 1. In a first modified acoustic structure (first modification) 1*a* of FIG. 12, the hollow member 10*a*, which is a casing of the acoustic structure, is in the form of a generally U shape member. The generally U-shape member 10*a* has a "U" sectional shape when cut in a direction perpendicular to the extending direction of the member and has a hollow interior space. The generally U-shape member 10*a* is fixedly attached to the reflective surface 200 in such a manner that the opening side of the section is closed with the reflective surface 200. Thus, an interior hollow region 20*a* having a rectangular sectional shape is defined by the space surrounded by the U-shape member 10*a* and the reflective surface 200. Further, the opening portion 14*a* is provided in a side surface that lies in non-parallel relation to the reflective surface 200 of the U-shape member 10*a*; in the illustrated example, the side surface is a vertical side surface. The opening portion 14*a* communicates the interior hollow region 20*a* with the external space. Even with such a modification, where the interior hollow region 20*a* is defined by the space surrounded by the U-shape member (or case) 10*a* and the reflective surface 200, a sound absorbing effect and sound scattering effect can be achieved through similar actions to the above-described preferred embodiment.

Figure 13A:
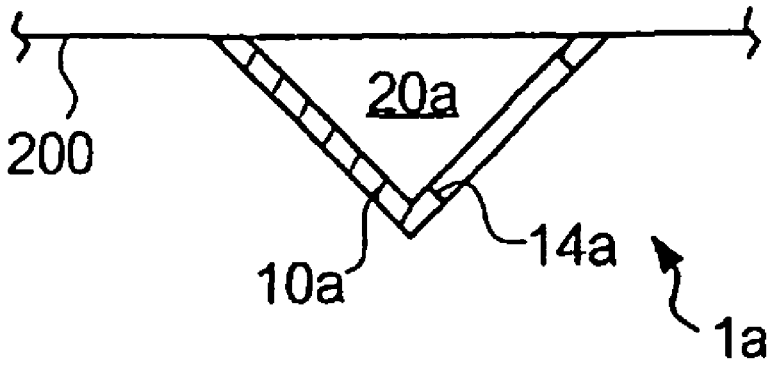
FIGS. 13A to 13C are sectional views of the first modified acoustic structure.
Figure 13B:
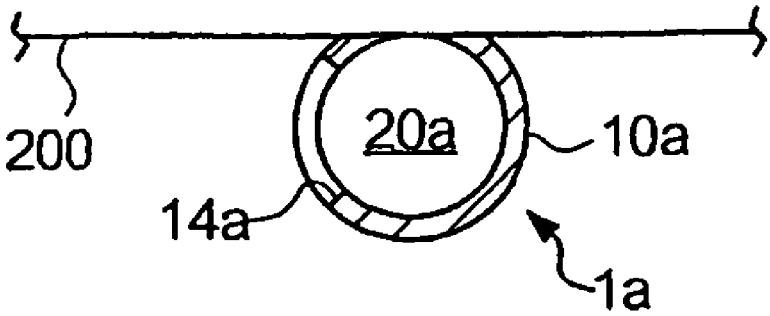

The interior hollow region 20*a* need not necessarily have a rectangular sectional shape when cut in the direction perpendicular to the extending direction of the member and may have a triangular sectional shape as shown in FIG. 13A, a generally ellipsoidal or circular sectional shape as shown in FIG. 13B, or any other suitable sectional shape. In each of the cases, the opening portion 14*a* is provided in non-parallel relation to the reflective surface 200.

Figure 13C:
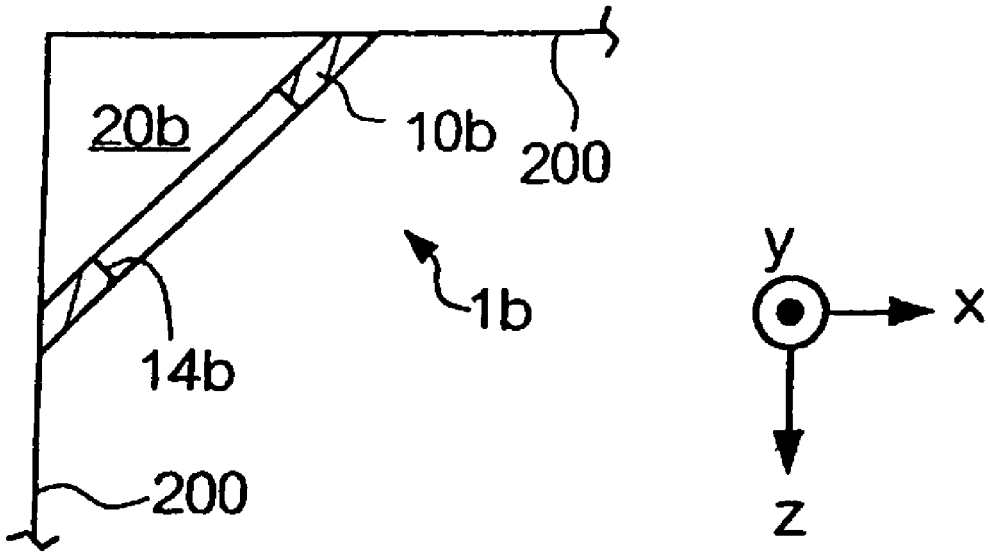

Further, as shown in FIG. 13C, another modified acoustic structure may be constructed using an interior corner portion of the acoustic room. Let it be assumed here that, in the acoustic room of a rectangular parallelepiped or cubic shape, an interior corner portion having an "L" sectional shape along the x-z plane is defined by the ceiling C and wall surface W. The hollow member 10*b*, which is a casing of the acoustic structure 1*b*, extends in the y direction and is fixedly attached to the ceiling C and wall surface W in such a manner that a space (or interior hollow region 20*b*) surrounded by the ceiling C, wall surface W and hollow member 10*b* has a triangular sectional shape. Further, the interior hollow region 20*b* is in communication with the external space via the opening portion 14*b*. In this case too, the opening portion 14*b* is provided in non-parallel relation to the reflective surface 200. With this modified acoustic structure 1*b* too, each of the ceiling C and wall surface W functions as the reflective surface 200, and sound absorbing and sound scattering effects can be achieved through relationship between reflected waves from the reflective surface 200 and reflected waves from the opening portion 14*b*.

(Modification 2)

Because a door (fittings), through which a user go in and out of an acoustic room, is provided on a wall surface of an acoustic room, an acoustic structure may be constructed using a door frame (fittings frame). FIGS. 14A to 14D are views showing such a modified acoustic structure. More specifically, FIG. 14A shows a wall surface W having a door frame 300 provided thereon and other elements (ceiling, wall surfaces and floor surface) around the wall surface W when a door D is in its closed position, and FIG. 14B to 14D show the door frame 300 as viewed in directions of arrows IV, V and VI, respectively, of FIG. 14A.

A rectangular door opening is provided in the wall surface W. As shown in FIG. 14A, the door frame 300 is constructed of three acoustic structures 10 disposed, along the inner periphery of the door opening, in an inverted-U shape configuration opening toward the floor surface. Broken lines in FIGS. 14B to 14D indicate interior hollow regions 20 having dimensions corresponding to an intended resonant frequency.

With the door frame 300 constructed of the acoustic structures 10, the acoustic structures 10 can be made less noticeable, which is very suitable for securing an aesthetic outer appearance of the acoustic room. Any other suitable frame than the door frame 300, such as a frame provided along an opening for mounting therein a sliding door or fusuma (Japanese sliding door), a window sash frame or a frame for mounting therein a painting, photo or the like, may be constructed using the aforementioned hollow structures. Namely, wooden or metal members forming a frame surrounding a predetermined region, such as an opening, may be replaced with the aforementioned hollow members 10, to thereby construct the acoustic structure 1*c*.

(Modification 3)

Figure 15:
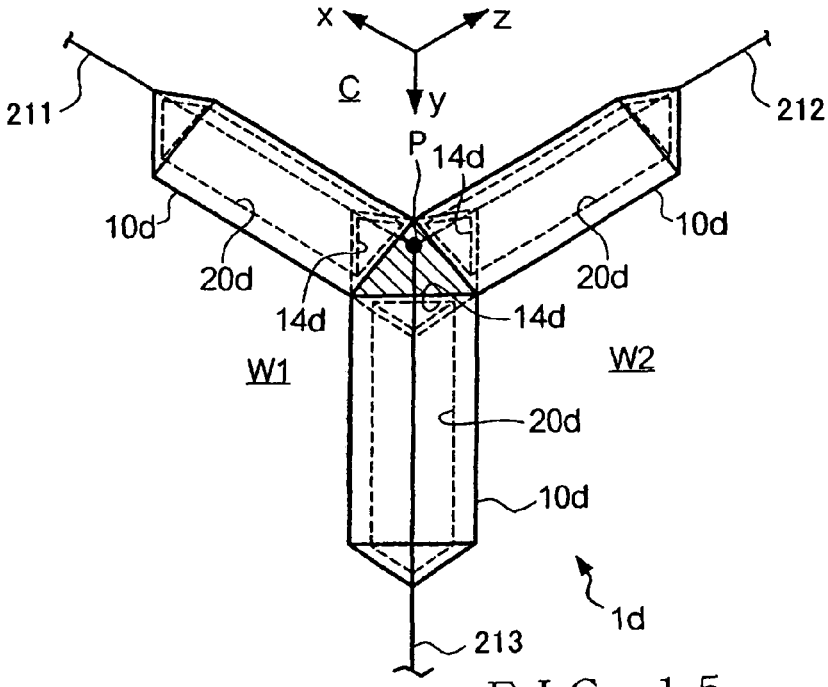
FIG. 15 is a sectional view of a third modified acoustic structure.

Another modified acoustic structure (third modification) may be constructed using an interior corner portion of an acoustic room as shown in FIG. 15. Let it be assumed here that the acoustic structure 1*d* is constructed in the acoustic room having a rectangular parallelepiped (or cubic) shape. Here, the interior corner portion is formed with three surfaces, i.e. a ceiling C and wall surfaces W1 and W2, intersecting one another at right angles at an intersecting point P. The acoustic structure 1*d* includes three cylindrical or tubular hollow members 10*d* each having a triangular sectional shape. Each of the hollow members 10*d* has an interior hollow region 20*d* that is closed at one end and open at the other end; namely, each of the hollow members 10*d* is a one-end-open tubular member. In this case, none of side surfaces of each of the hollow members 10*d* are open, and the hollow member 10*d* has an opening portion 14*d* in only one of the opposite end surfaces. The three hollow members 10*d* are disposed in such a way as to contact boundary lines (i.e., arris lines) 211-213 among the ceiling C and wall surfaces W1 and W2. Further, the opening portion 14*d* of each of the hollow members 10*d* faces the intersecting point P where the arris lines 211-213 intersect one another. In such an acoustic structure 1*d*, a space is formed in a position, indicated by hatching in FIG. 15, between the opening portions 14*d* of the three hollow members 10*d*, and this space functions in a similar manner to the intermediate layer 13 of the above-described preferred embodiment. Thus, with the modified acoustic structure 1*d*, a sound absorbing effect and sound scattering effect can be achieved through similar actions to the above-described preferred embodiment.

In the modified acoustic structure 1*d*, the three hollow members 10*d* need not necessarily be disposed to intersect one another at right angles, depending on angles at which the ceiling and wall surfaces intersect one another. Further, the hollow members 10*d* may be formed integrally with one another. Furthermore, the acoustic structure 1*d* may be provided in an interior corner portion defined by the floor surface and the wall surfaces.

(Modification 4)

Figure 16A:
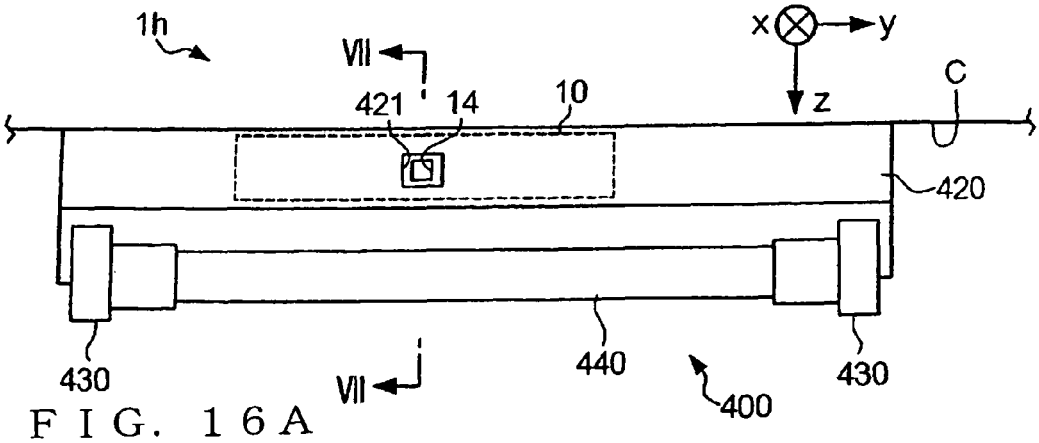
FIGS. 16A and 16B are views of a fourth modified acoustic structure.
Figure 16B:
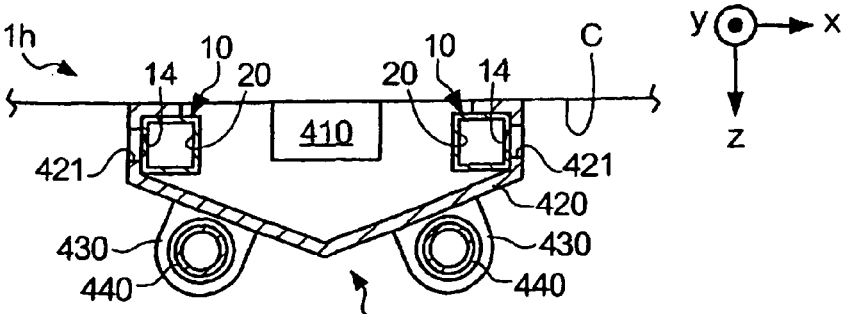

The acoustic structure of the present invention may comprise an illuminating device installed in an acoustic room. FIGS. 16A and 16B shows the illuminating apparatus 400 with such a modified acoustic structure 1*h* provided therein, of which FIG. 16A shows a horizontal side view of the illuminating apparatus 400 and FIG. 16B is a sectional view of the illuminating apparatus 400 taken along the VII-VII line of FIG. 16A.

As shown in FIGS. 16A and 16B, the illuminating apparatus 400 is a straight tube fluorescent lamp device, which includes a lighting device 410, a reflective plate 420, two pairs of sockets 430, two fluorescent lamps 440 and hollow members 10. The lighting device 410 includes, for example, a lighting component, such as an inverter, and it is provided within the illuminating apparatus 400 and fixed to a ceiling C. The lighting device 410 turns on the fluorescent lamps 440 by using commercial electric power to supply electric power to the sockets 430 via power lines (not shown) and turns off the fluorescent lamps 440 by stopping the electric power supply to the sockets 430. The reflective plate 420, which has a generally "V" sectional shape, is a member having superior reflectiveness formed by performing a surface process on an aluminum substrate. The reflective plate 420 reflects light, radiated from the fluorescent lamps 440, toward an acoustic space. Each of the pairs of sockets 430 includes pin supports (not shown) that detachably support one of the fluorescent lamps 440 by holding the fluorescent lamp 440 between the opposed surfaces of the pin supports and applies a voltage to the fluorescent lamp 440. Each of the fluorescent lamps 440 is a straight tube fluorescent lamp that is detachably attached to the body of the illuminating apparatus 400. The hollow member 10 is provided in an interior space of the illuminating apparatus 400 between the reflective plate 420 and the ceiling C. Each of the hollow member 10 extends parallel to the length of the fluorescent lamps 440. The hollow member 10 has an opening portion 14 located between the reflective plate 420 and the ceiling C and in communication with the external space via a hole 421 formed in the reflective plate 420.

Namely, the modified acoustic structure 1*h* includes the hollow members 10 disposed inside the illuminating apparatus 400 and close to the ceiling C. Thus, the hollow members 10 are almost invisible from outside the illuminating apparatus 400, so that the hollow members 10 never impair an aesthetic outer appearance of the acoustic room and hardly narrows the acoustic space. Further, if the hollow members 10 are provided integrally with the illuminating apparatus 40, the acoustic structure 1*h* can be mounted on a building structure with ease without using a special architechtural technique. Alternatively, an acoustic structure may be constructed by incorporating the hollow member 10 in another type of apparatus, such as an air fan, provided on the ceiling.

(Modification 5)

Figure 17:
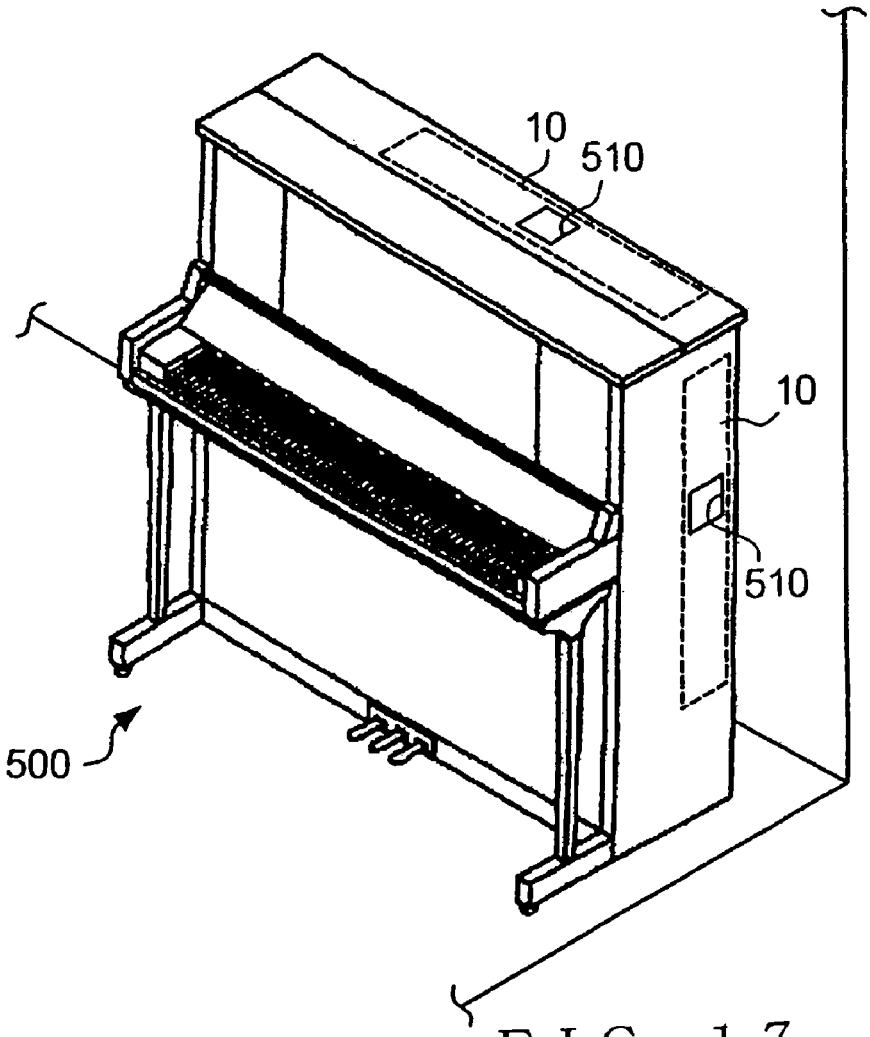
FIG. 17 is a sectional view of a fifth modified acoustic structure.

As shown in FIG. 17, an acoustic structure may be constructed by providing the hollow member 10 within an upright piano 500. In a case where the upright piano 500 is installed in an acoustic room, the casing of the upright piano 500 is often placed in contact with or close to a wall surface of the acoustic room. In such a case, tones (particularly low-pitched tones) generated by a performance of the piano 500 propagate through a wall surface to create a noise problem. To avoid the noise problem, the hollow member 10 is mounted within the upright piano 500, and the casing of the upright piano 500 has holes 510 formed therein to be located close to one or more of the wall surfaces and the floor surface of the acoustic room when the piano 500 is installed in the acoustic room. The holes 51 communicate the opening portion 14 with the external space, so that an external sound can enter the interior hollow region 20 of the hollow member 10 via the holes 510 and opening portion 14. The wall surfaces, floor surface and casing of the upright piano 500 can function as the reflective surface of the present invention. The acoustic structure constructed in this manner does not impair the outer appearance of the acoustic room, does not narrow the acoustic room by its installation in the acoustic room and can achieve appropriate sound absorbing and scattering effects for performance tones including low-pitched tones.

As noted above, the upright piano 500 includes the casing having the holes 510 formed therein for communicating the interior hollow region 20 of the hollow member 10, disposed inside the casing, with the external space. The upright piano 500 is installed in the acoustic room in such a manner that the holes 510 do not lie parallel to reflective surfaces (such as a wall surface) of the acoustic room which radiates reflected waves corresponding to incident sound waves.

This modified acoustic structure may be provided within any other type of piano than an upright piano, such as a grand piano or electronic piano, or within any suitable floor-mounted keyboard instrument, such as an acoustic organ or electronic organ such as "ELECTONE" (registered trademark) installed in an acoustic room. Further, the modified acoustic structure constructed in the aforementioned manner may be provided in any one of various articles such as pieces of furniture and equipment, like a table, chair, sofa, cupboard, utensil, television, radio, cabinet or casing of a washing machine or other electric equipment and a partition, installed in an acoustic space.

(Modification 6)

As noted above, the frequency bands over which the acoustic structure of the present invention can achieve appropriate sound absorbing and scattering effects depends on the dimensions of the hollow region. The acoustic structure of the present invention may be modified to have a construction for adjusting such frequency bands over which the acoustic structure of the present invention can achieve appropriate sound absorbing and scattering effects.

Figure 18:
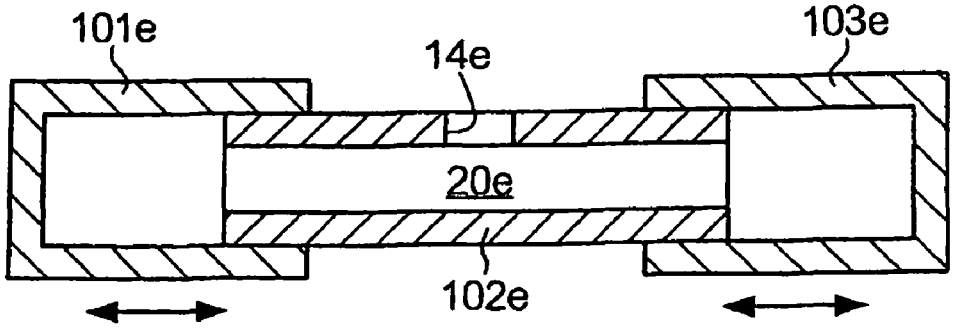
FIG. 18 is a sectional view of a sixth modified acoustic structure.

FIG. 18 is a sectional view illustrating a telescopic (expandable and contractable) hollow member employed in such a modified acoustic structure. The hollow member of FIG. 18 includes a first member 101*e*, a second member 102*e* and a third member 103*e*, each of which is formed in a cylindrical shape. The hollow member also has an interior hollow region 20. The first and third members 101*e* and 103*e* are constructed to be fittable into the second member 102*e*, for example, by internal threads formed in the first and third members 101*e* and 103*e* engaging with an external thread formed on the second member 102*e*, so that the first and third members 101*e* and 103*e* are movable relative to the second member 102*e* in directions indicated by arrows. Alternatively, the first and third members 101*e* and 103*e* may be constructed to slide inside the second member 102*e*. Through such movement of the first and third members 101*e* and 103*e* relative to the second member 102*e*, the length (dimension) of the interior hollow region 20*e* can be changed, so that the frequency bands over which the acoustic structure of the present invention can achieve appropriate sound absorbing and scattering effects can vary.

In this modification, it is desirable that the first and third members 101*e* and 103*e* should not move spontaneously. Any other suitable conventionally-known construction may be employed for changing the length of the interior hollow region 20*e*.

(Modification 7)

Figure 19A:
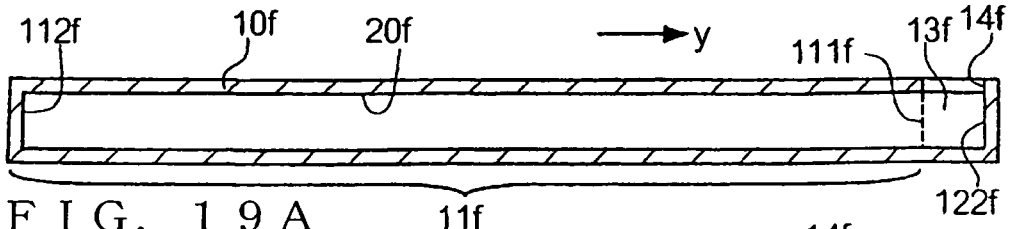
FIGS. 19A and 19B are views of a seventh modified acoustic structure.
Figure 19B:
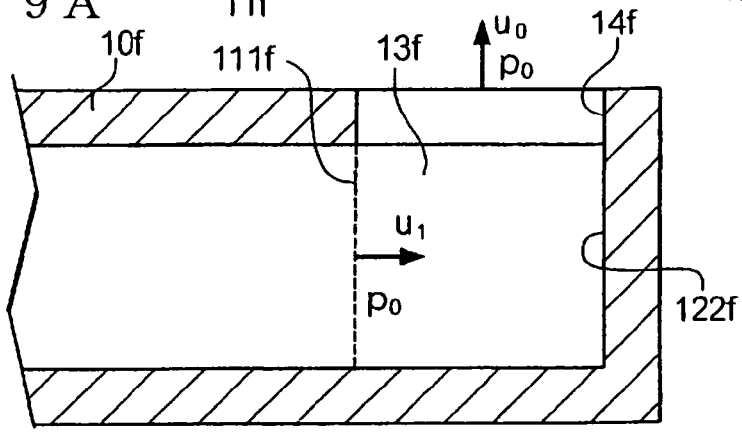

Whereas the hollow member 10 in the above-described preferred embodiment of the acoustic structure 1 includes two resonators 11 and 12, the hollow member in still another modified may include only one resonator. FIGS. 19A and 19B are sectional views of the hollow member 10*f* in the modified acoustic structure taken along the same direction as the III-III line of FIG. 1.

As shown in FIG. 19A, the hollow member 10*f* includes an interior hollow region 20*f* extending in the y direction, and a resonator 11*f* defined from one end 112*f*, which is a closed end, to an intermediate layer 13*f*. The hollow member 10*f* also includes an opening portion 14*f* formed in a side surface portion continuing to the other end 122*f* of the hollow member 10*f*. Such a modified acoustic structure can be even further reduced in size. FIG. 19B is explanatory of how the intermediate layer 13*f* behaves when the resonator 11*f* has resonated. As shown in FIG. 19B, the intermediate layer 13*f* behaves in the same manner as in the above-described preferred embodiment, so that the modified acoustic structure can achieve sound absorbing and scattering effects similar to those achieved by the above-described preferred embodiment.

(Modification 8)

Figure 20:
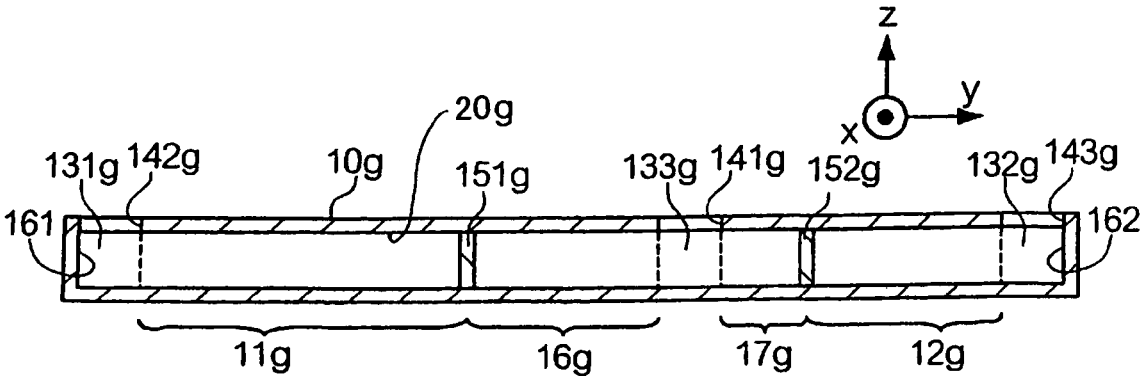
FIG. 20 is a sectional view of an eighth modified acoustic structure.

The hollow member may also be modified as follows. FIG. 20 is a sectional view of a modified hollow member taken along the same direction as the III-III line of FIG. 1.

As shown in FIG. 20, the modified hollow member 10*g* is closed at opposite ends and has opening portions 142*g* and 143*g* formed therein near the closed ends and another opening portion 141*g* formed near a middle region thereof in the y direction. Further, partition walls 151*g* and 152*g* are provided for partitioning, in the y direction, an interior hollow region 20*g* into a plurality of hollow regions; thus, three interior hollow regions are formed which are partitioned from one another in the extending direction of the interior hollow region 20*g*. Here, the partition walls 151*g* and 152*g* may be formed integrally with the hollow member 10*g* or separately from the hollow member 10*g*. In the hollow member 10*g* constructed in the aforementioned manner, an intermediate layer 131*g* is provided between one end 161 of the hollow member 10*g* and a resonator 11*g*, and another intermediate layer 132*g* is provided between the other end 162 of the hollow member 10*g* and a resonator 12*g*. Furthermore, in an intermediate hollow region formed between the partition walls 151*g* and 152*g*, another resonator 16*g* is provided between the partition wall 151*g* and still another intermediate layer 133*g*, and still another resonator 17*g* is provided between the partition wall 152*g* and the intermediate layer 133*g*.

Namely, in the aforementioned hollow member 10*g*, the interior hollow region 20*g* is partitioned by the partition walls into the a plurality of hollow regions in the extending direction of the hollow region 20*g*, and the resonators are provided between the partition walls and the intermediate layers. Thus, the four resonators are provided in the hollow member 10*g*; that is, in this modification, a greater number of the resonators can be secured than in the above-described preferred embodiment. Thus, the modified acoustic structure 1 can achieve sound absorbing and sound scattering effects over even wider frequency bands than the above-described preferred embodiment of the acoustic structure. Further, the hollow member 10*g* may include a greater number of partition walls than the above-mentioned so as to provide a greater number of interior hollow regions.

(Modification 9)

Whereas the hollow member 10 in the above-described preferred embodiment is constructed in such a manner that the two resonators 11 and 12 share the same center axis yo, the two resonators 11 and 12 need not necessarily share the same center axis yo. For example, the two resonators 11 and 12 may be disposed at a predetermined angle relative to each other, e.g. in an "L" or "V" shape configuration. Further, the hollow member may be constructed in such a manner that more resonators face the intermediate layer 13. Furthermore, the resonators need not be disposed in the same plane (x-y plane) and may extend in any desired directions in the x-y-z space.

(Modification 10)

Whereas the hollow member 10 in the above-described preferred embodiment is closed at the opposite ends 112 and 122, either or both of the ends 112 and 122 may be open (i.e., the hollow member 10 may be constructed as an open tube). Where the hollow member 10 is open at both of the ends 112 and 122, the wavelengths $\lambda_1$ and $\lambda_2$ corresponding to the resonant frequencies of the resonators 11 and 12, having a hollow region open at the opposite ends, satisfy relationship represented by Mathematical Expression (5) below using the respective lengths $l_1$ and $l_2$, in the y direction, of the resonators 11 and 12, where n is an integral number equal to or greater than one and open end correction is ignored.

$$l_i = n \cdot \lambda_i / 2 \quad (i = 1,2) \tag{5}$$

If both of the ends 112 and 122 are open like this, lengths $l_1$ and $l_2$, each of which is a multiple of a half of the wavelength $\lambda_1$ or $\lambda_2$ corresponding to the resonant frequency; thus, the hollow member 10 can be designed to achieve intended resonant frequencies.

(Modification 11)

Whereas the above-described preferred embodiment of the acoustic structure 1 is constructed in such a manner that the hollow member 10 satisfies the relationship of $2S_p > S_o > 1$, such relationship need not necessarily be satisfied. Even with other relationship than the relationship of $2S_p > S_o > 1$, sound absorbing and scattering effects can be achieved through behavior similar to that of the above-described embodiment as long as the real part of the specific acoustic impedance ratio $\zeta$ is almost zero.

Further, the opening portions 14 may be covered with nonwoven cloth, net, mesh or other material having a sound pressure transmission characteristic and air permeability (particle velocity transmission characteristic), as long as sound waves can propagate between the external space and the interior hollow region 20 via the opening portions 14.

Further, whereas the hollow member 10 in the above-described preferred embodiment is provided on an inner wall surface or ceiling of the acoustic room, the hollow member 10 may be embedded in an inner wall surface or ceiling of the acoustic room. Further, the hollow member 10 may be provided on a flat support panel, in which case the surface of the support panel corresponds in function to the reflective surface 200. Further, moving means, such as casters, may be provided on the support panel, so as to construct a movable support panel.

(Modification 12)

Whereas the hollow member 10 in the above-described preferred embodiment has been described as having a cylindrical shape having a rectangular sectional shape, it may be of a circular columnar shape or any other columnar shape having a polygonal bottom surface. Further, the sectional shape of the hollow region when cut vertically to the center axis thereof may be circular or polygonal rather than being limited to those mentioned in relation to the preferred embodiment. Further, the sectional shape of the hollow region 20 when cut along the x-z plane may be other than the above-mentioned and need not necessarily be uniform along the extending direction (or length) of the hollow region 20.

Further, whereas the above-described preferred embodiment of the acoustic structure 1 is constructed in such a manner that the opening portion 14 lies in non-parallel relation to the reflective surface 200, the opening portion 14 may lie parallel to the reflective surface 200, in which case too there can be achieved substantially the same sound absorbing and scattering effects through occurrence of acoustic phenomena as shown in FIG. 11.

(Modification 13)

In the above-described preferred embodiment, where the lengths of the resonators 11 and 12 equal each other (i.e., $l_1=l_2$), the particle velocity $u_1$ at the boundary surface 111 and the particle velocity $u_2$ at the boundary surface 121 vary in phase with each other. Thus, the above-described preferred embodiment is suited to increase the particle velocity of gas molecules at the opening portion 14 in given frequency bands and thereby enhance sound absorbing and sound scattering effects in the frequency bands. If, on the other hand, the resonators 11 and 12 have different lengths (i.e., $l_1 \neq l_2$), the specific acoustic impedance ratio $\zeta$ becomes smaller than one ($\zeta<1$), so that the frequency bands over which sound absorbing and sound scattering effects are achievable can be widened. In this case, the specific acoustic impedance ratio $\zeta$ of the opening portion 14 varies irregularly on the basis of the relationship of Mathematical Expression (4). Thus, where the individual frequency bands where the specific acoustic impedance ratio $\zeta$ is smaller than one ($\zeta<1$) may become narrower than those in the case where $l_1=l_2$, the frequency bands satisfying the condition can be wider in the case where $l_1 \neq l_2$ than in the case where $l_1=l_2$, if the frequency bands satisfying the condition are added together. It can be said that such an advantageous benefit is achievable just because the acoustic structure achieves sound absorbing and sound scattering effects by providing not only full resonance at the specific acoustic impedance ratio $\zeta$ of zero ($\zeta=0$) but also a phenomenon that can be regarded as a resonance phenomenon by the specific acoustic impedance ratio $\zeta$ becoming greater than zero but smaller than one ($0<\zeta<1$). Even in this case, there can be achieved an advantageous benefit of an increased particle velocity, i.e. $u_0>u_1+u_2$, if the condition of $S_p>S_o$ is satisfied.

(Modification 14)

Whereas the above-described preferred embodiment and modifications of the acoustic structure of the present invention have been described as comprising the hollow member 10 and the reflective surface provided separately from each other, the hollow member 10 and the reflective surface may be formed integrally with each other. Particularly, the hollow member 10 need not necessarily be in the form of a casing member separately from a member functioning as the reflective surface. The above-described preferred embodiment and modifications of the acoustic structure of the present invention can be installed in various acoustic rooms where acoustic characteristics are controlled. Here, the various acoustic rooms may be soundproof rooms, halls, theaters, listening rooms for acoustic equipment, sitting rooms like meeting rooms, spaces of various transport equipment, casings of speakers, musical instruments, etc., and so on.

(Modification 15)

The present invention may also be embodied as a method for designing the inventive acoustic structure constructed in the above-described manner. Namely, the method of the present invention is directed to designing the acoustic structure which comprises the resonators having the hollow region extending in one direction, the hollow region communicating with the external space via the opening portion, and the reflective surface disposed close to the opening portion and facing the external space. The resonators and the opening portion are designed in such a manner that, under a condition where incident sound waves fall in the opening portion and fall on the reflective surface from the external space and where, in response to the incident waves, the reflective surface radiates reflected waves and the resonators radiate reflected waves, differing in phase from the reflected waves from the reflective surface, through the opening portion, a real part of a value calculated by dividing the specific acoustic impedance of the opening portion by the characteristic impedance of the medium of the opening portion is caused to approach zero.

Further, the present invention may also be embodied as a designing apparatus and program for calculating design conditions of the inventive acoustic structure constructed in any of the above-described manners, and as a recording or storage medium having such a program stored therein.

Figure 21:
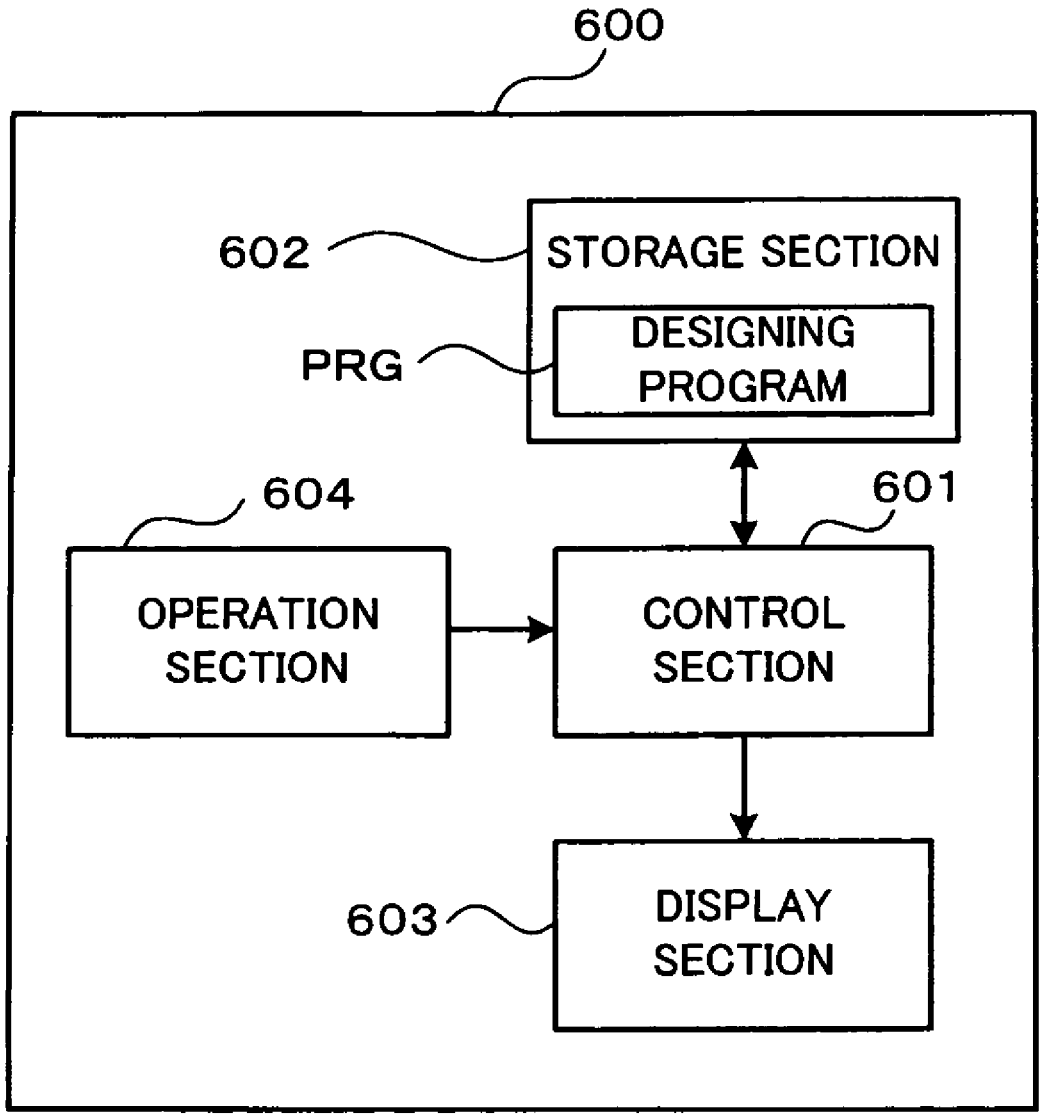
FIG. 21 is a block diagram showing an example hardware setup of a designing apparatus for calculating design conditions of the acoustic structure.

FIG. 21 is a block diagram showing an example hardware setup of the designing apparatus 600 for calculating the design conditions of the inventive acoustic structure. The designing apparatus 600 is in the form of a computer where a control section 601, including an arithmetic operation device having a CPU (Central Processing Unit) and a memory, executes a designing program PRG, stored in a storage section (or storage medium) 602, to thereby implement a particular function.

A display section 603 includes, for example, a liquid crystal display as a display device for displaying images and the like, and, under control of the control section 601, the display section 603 displays a screen for manipulating the designing apparatus 600, results of arithmetic operations of the control section 601, and so on.

An operation section 604 includes a keyboard and a mouse for manipulating the designing apparatus 600. Various inputs are made to the designing apparatus 600 by a human operator or user operating the keyboard and the mouse.

The storage section 602, which includes a hard disk device, has stored therein a designing program for implementing a function to calculate design conditions of the acoustic structure.

The control section 601 executes the designing program PRG, stored in the storage 602, to calculate design conditions of the acoustic structure. For example, assuming that the acoustic structure is constructed in the same manner as the preferred embodiment of the acoustic structure, and under a condition where incident sound waves fall in the opening portion and fall on the reflective surface from the external space, and, in response to the incident waves, the reflective surface radiates reflected waves and the resonators radiate reflected waves, differing in phase from the reflected waves from the reflective surface, through the opening portion 14, the control section 601 calculates respective design conditions of the resonators 11 and 12 and the opening portion 14 such that the real part of the specific acoustic impedance ratio $\zeta$ of the opening portion 14 is caused to approach zero. Examples of the design conditions include conditions related to a size of the opening portion 14, a size and shape of the resonators 11 and 12, material characteristics of component elements of the resonators 11 and 12 (e.g., level of a resistance element) and a medium (normally, air) of a space where the acoustic structure is constructed. It is deemed that, as the size of the opening portion 14 increases and the sectional area of the resonators 11 and 12 decreases, for example, the area ratio rs decreases as noted above and thus the real part of the specific acoustic impedance ratio $\zeta$ of the opening portion 14 approaches zero ("0"). Further, the value of the real part also depends on the component elements of the resonators, and thus, correspondence relationship between the component elements and the value of the real part may be determined experimentally in advance and used for the aforementioned purpose.

It is more preferable if the designing apparatus 600 calculates design conditions such that the absolute value of the specific acoustic impedance ratio $\zeta$ becomes less than one.

Further, the material and shape of the reflective surface 200 may be added to an arithmetic algorithm of the designing program PRG. Namely, the control section 601 only need to perform the arithmetic operations in such a manner as to satisfy conditions for achieving the above-mentioned sound absorbing and sound scattering effects. Further, in some case, component elements of the resonators may have already been determined beforehand; in such a case, one or some of a plurality of the design conditions may be designated by the user.

It should be appreciated that the aforementioned designing apparatus and program for calculating design conditions of the acoustic structure may also be applied to designing of the modified acoustic structures (i.e., Modification 1-Modification 15).

This application is based on, and claims priority to, JP PA 2009-053709 filed on 6 Mar. 2009 and JP PA 2010-047185 filed on 3 Mar. 2010. The disclosure of the priority applications, in its entirety, including the drawings, claims, and the specification thereof, is incorporated herein by reference.

What is claimed is:

1. An acoustic structure comprising a hollow member, said hollow member adapted to be disposed close to a reflective surface which faces to an external space, said hollow member comprising:

a hollow region formed in the hollow member; and an opening portion communicating the hollow member with the external space, wherein the hollow member is disposed close to the reflective surface in such a manner that the opening portion of the hollow member is disposed adjacent to the reflective surface, wherein incident sound waves fall in the opening portion and fall on the reflective surface from the external space, wherein a space portion of the hollow region adjoining and communicating with said opening portion is constructed as an intermediate layer, and a portion of said hollow region extending from one end of the hollow region to the intermediate layer is constructed as a resonator, and wherein the hollow member is configured such that a ratio of an area of the opening portion to an area of a boundary surface between the resonator and the intermediate layer decreases.

2. The acoustic structure as claimed in claim 1, wherein the opening portion lies in non-parallel relation to the reflective surface.

3. The acoustic structure as claimed in claim 2, wherein the opening portion lies in a direction normal to the reflective surface.

4. The acoustic structure as claimed in claim 1, wherein a sectional size of the hollow region in a direction normal to the extended direction of the hollow region is considerably small as compared to a wavelength of a resonant frequency of the resonator.

5. The acoustic structure as claimed in claim 1, wherein the hollow region has a first and second portions, the first portion of said hollow region extending from one end of the hollow region to the intermediate layer to be constructed as a first resonator, the second portion of said hollow region extending from another end of the hollow region to the intermediate layer to be constructed as a second resonator.

6. The acoustic structure as claimed in claim 1, wherein said intermediate layer is located at one end of said hollow region, and the portion of said hollow region constructed as the resonator extends from another end of the hollow region to the intermediate layer.

7. The acoustic structure as claimed in claim 1, wherein said hollow member forms a plurality of the hollow regions partitioned from each other by a partition wall, and wherein each of said plurality of the opening portions is provided in a different one of the hollow regions.

8. The acoustic structure as claimed in claim 1, wherein said hollow member forms a plurality of the hollow regions disposed at an angle relative to each other.

9. The acoustic structure as claimed in claim 1, wherein said opening portion is covered with a material having a sound pressure transmission characteristic.

10. The acoustic structure as claimed in claim 1, wherein said hollow member has a slide structure for variably adjusting a length of said hollow region.

11. The acoustic structure as claimed in claim 1, which is adapted to be provided in a predetermined structure of a musical instrument.

12. The acoustic structure as claimed in claim 1, which is adapted to be provided in at least one of fittings, illumination device, wall and ceiling of an acoustic room and other building structure.

13. An acoustic structure comprising a hollow member, said hollow member adapted to be disposed close to a reflective surface which faces to an external space, said hollow member comprising:

a hollow region formed in the hollow member; and an opening portion communicating the hollow member with the external space, wherein the hollow member is disposed close to the reflective surface in such a manner that the opening portion of the hollow member is disposed adjacent to the reflective surface, wherein a space portion of the hollow region adjoining and communicating with said opening portion is constructed as an intermediate layer, and a portion of said hollow region extending from one end of the hollow region to the intermediate layer is constructed as a resonator, wherein, when the reflective surface radiates reflected waves, said resonator resonates in response to the incident sound waves and radiates reflected waves, differing in phase from the reflected waves from said reflective surface, via the opening portion, and wherein a layer of gas where sound pressure is distributed uniformly is provided between the portion of said hollow region as the resonator and the opening portion, and an absolute value of a motion velocity of medium particles in the opening portion is greater than an absolute value of a motion velocity of medium particles on a boundary surface between the hollow region and the layer of gas.

14. The acoustic structure as claimed in claim 1, wherein the opening portion has a square shape with sides of distance d, and each side of the opening portion satisfies relationship of $d<\lambda/6$ with respect to a wavelength $\lambda$ corresponding to a resonance frequency of the resonator.

15. The acoustic structure as claimed in claim 1, wherein said intermediate layer is constructed in such a manner that, when the reflective surface radiates reflected waves corresponding to incident sound waves falling from the external space on said opening portion and the reflective surface of said hollow member, said intermediate layer not only causes reflected waves, produced through resonance of said resonator and differing in phase from the reflected waves from said reflective surface, to be radiated from said opening portion but also makes less than an absolute value of a value obtained by dividing a specific acoustic impedance of said opening portion, at a time of radiation of the reflected waves from said opening portion, by a characteristic impedance of a medium of said portion for the incident sound waves of resonance frequency band.

16. The acoustic structure as claimed in claim 15, wherein said intermediate layer is constructed in such a manner that, when the reflective surface radiates the reflected waves corresponding to the incident sound waves falling from the external space on said opening portion and the reflective surface of said hollow member, a real part of the value obtained by dividing the specific acoustic impedance of said opening portion by the characteristic impedance of the medium of said opening portion is substantially zero for the incident sound waves of the resonance frequency band.

* * * * *